US006670943B1

(12) United States Patent
Ishii et al.

(10) Patent No.: US 6,670,943 B1
(45) Date of Patent: Dec. 30, 2003

(54) DRIVING CIRCUIT SYSTEM FOR USE IN ELECTRO-OPTICAL DEVICE AND ELECTRO-OPTICAL DEVICE

(75) Inventors: Kenya Ishii, Suwa (JP); Masahide Uchida, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/362,654

(22) Filed: Jul. 29, 1999

(30) Foreign Application Priority Data

Jul. 29, 1998 (JP) ..... 10-214597
Nov. 30, 1998 (JP) ..... 10-339604
Jun. 17, 1999 (JP) ..... 11-171260

(51) Int. Cl.[7] ..... G09G 3/18
(52) U.S. Cl. ..... 345/100; 345/92; 345/205
(58) Field of Search ..... 345/87, 88, 89, 345/92, 98–100, 55, 211, 204, 205, 206; 377/64, 73, 74–76

(56) References Cited

U.S. PATENT DOCUMENTS 4,746,915 A * 5/1988 Sekiya ..... 345/205
4,870,399 A * 9/1989 Carlson ..... 345/55
4,917,468 A * 4/1990 Matsuhashi et al. ..... 340/805
5,021,774 A * 6/1991 Ohwada et al. ..... 345/90
5,200,847 A * 4/1993 Mawatari et al. ..... 359/59
5,400,050 A * 3/1995 Matsumoto et al. ..... 345/100
5,412,397 A * 5/1995 Kanatani et al. ..... 345/99
5,619,225 A * 4/1997 Hashimoto ..... 345/98
5,856,816 A * 1/1999 Youn ..... 345/98
5,872,563 A * 2/1999 Asada ..... 345/212
5,883,609 A * 3/1999 Asada et al. ..... 345/100
6,072,456 A * 6/2000 Karube et al. ..... 345/98
6,175,352 B1 * 1/2001 Kay et al. ..... 345/100

FOREIGN PATENT DOCUMENTS

JP 02082295 A * 3/1990 ..... G09G/3/36

* cited by examiner

*Primary Examiner*—Lun-Yi Lao
(74) *Attorney, Agent, or Firm*—Oliff & Berridge, PLC

(57) ABSTRACT

An electro-optical device copes with a decreased size of a pixel pitch by using a comparatively simple configuration in which a driving circuit system is formed on one substrate. In a scanning-line driving circuit, each transfer signal of a shift register is branched off into three signal components, and an enable circuit is provided for each signal component. During a pulse cycle of the transfer signal, one transfer signal is divided into three components while being sequentially shifted in the time domain in accordance with enable signals whose phases are sequentially shifted from each other, and the divided components are output as scanning signals. The same applies to a data-line driving circuit.

13 Claims, 21 Drawing Sheets

DRIVING CIRCUIT SYSTEM FOR USE IN ELECTRO-OPTICAL DEVICE AND ELECTRO-OPTICAL DEVICE

BACKGROUND OF THE INVENTION

1. Field of Invention

The present invention relates to a driving circuit system for use in an active-matrix-type electro-optical device and for driving the electro-optical device, and also to an electro-optical device driven by this driving circuit system.

2. Description of Related Art

Generally, in an active matrix type electro-optical device, a plurality of scanning lines and a plurality of data lines are arranged in a matrix, and pixel electrodes are formed via switching elements, such as thin film diodes (hereinafter referred to as "TFDs") and thin film transistors (hereinafter referred to as "TFTs") in correspondence with the intersections of the matrix.

In the electro-optical device configured as described above, scanning signals are sequentially supplied to the respective scanning lines by a scanning-line driving circuit. More specifically, the scanning-line driving circuit has a Y-direction shift register formed of unit circuits in multiple stages in the Y direction (vertical direction), which is the direction in which the scanning lines are arranged. First, the Y-direction shift register sequentially transfers a start pulse, which is supplied from an external image signal processing circuit at the start of a vertical scanning period, based on the period of a Y-direction clock signal CLY (and its inverted signal CLY'), which is used as the reference of vertical scanning, output from the external image signal processing circuit. The Y-direction shift register then supplies transfer signals as scanning signals from the respective stages of the unit circuits to the corresponding scanning lines.

Meanwhile, the data lines are driven by a data-line driving circuit. That is, the data-line driving circuit is configured to supply sampling control signals to sampling switches, which sample an image signal supplied to an image signal line in correspondence with the individual data lines, in synchronization with the above-described operation of sequentially supplying scanning signals. More specifically, the data-line driving circuit has a multiple-stage X-direction shift register in the X direction (horizontal direction), which is the direction in which the data lines are arranged. First, the X-direction shift register sequentially transfers a start pulse, which is supplied from the external image signal processing circuit at the start of a horizontal scanning period, based on the period of an X-direction clock signal CLX (and its inverted signal CLX'), which is used as the reference of horizontal scanning, output from the image signal processing circuit. The X-direction shift register then outputs transfer signals as sampling control signals from the respective stages of the unit circuits to the sampling switches connected to the corresponding data lines. Subsequently, the sampling switches respectively sample the image signal supplied to the image signal line according to the sampling control signals and supply the sampled image signal to the corresponding data lines.

As discussed above, generally, in the active-matrix-type electro-optical device, vertical scanning based on a field unit or a frame unit, namely, field scanning or frame scanning, is performed in accordance with the scanning signals and sampling control signals sequentially output from the shift registers.

When being put into practical use, this type of electro-optical device often has a built-in driving circuit system in which the aforementioned scanning-line driving circuit and the data-line driving circuit are formed, together with the switching elements connected to the pixel electrodes, on one of a pair of substrates forming the electro-optical device. In this case, a small space occupied by peripheral circuits including the driving circuits makes it possible to miniaturize the entire device. Additionally, active elements, which form the peripheral circuits, are formed by the same process step as the switching elements for driving the pixel electrodes, thereby enhancing the manufacturing efficiency of the whole device and decreasing the cost.

The size of the substrates is a factor that defines the size of the entire electro-optical device. Accordingly, the formation of a large peripheral portion on which the scanning-line driving circuit and the data-line driving circuit are formed in the peripheral region on the substrates, in relation to a screen display portion, contradicts the basic demand in this technical field for miniaturizing the entire electro-optical device and increasing relatively the screen display portion in relation to the size of the electro-optical device.

Thus, for the formation of the driving circuits on the substrate, in the Y-direction shift register of the scanning-line driving circuit, the circuit pitch in the Y direction of each unit circuit (hereinafter simply referred to as the "circuit pitch of the Y-direction shift register") is adjusted to the same pitch as that of the scanning lines. Accordingly, the Y-direction width of the portion required for forming the scanning-line driving circuit can be set to be substantially equal to the Y-direction width of the screen display portion. Similarly, in the X-direction shift register of the data-line driving circuit, the circuit pitch in the X direction of each unit circuit (hereinafter simply referred to as the "circuit pitch of the X-direction shift register") and the pitch in the X direction of the sampling switches of the sampling circuit (hereinafter simply referred to as the "pitch of the sampling switch") are adjusted to be the same pitch as that of the data lines. Accordingly, the X-direction width of the portion required for forming the data-line driving circuit can be set to be substantially equal to the X-direction width of the screen display portion. This makes it possible to reduce the widths in the X direction and in the Y direction of the substrates, thereby preventing a large scale of substrates.

These days, there is an intense demand for a higher level of image quality in the electro-optical device. In order to implement higher-definition images, it is thus necessary to reduce the pixel pitch to a very small size and also to driving a greater number of scanning lines and data lines at a higher frequency.

However, each unit circuit of the above-described shift registers is provided with a plurality of relatively complicated active elements. For example, each unit circuit requires at least three clocked inverters, each formed of four TFTs, positive and negative power sources for each clocked inverter, and wiring patterns for supplying a clock signal and its inverted signal. Accordingly, in the configuration in which peripheral circuits, such as the driving circuits, are formed on the substrate of the electro-optical device, as the pixel pitch is becoming smaller, it is more difficult to adjust the circuit pitches of the above-described Y-direction and X-direction shift registers to the same pitches of the scanning lines and the data lines. For example, under current circumstances, the smallest-possible circuit pitch of the shift registers is, in a practical sense, about 20 $\mu$m, which hampers a decrease in the pixel pitch.

SUMMARY

Accordingly, in view of the above background, the present invention provides a driving circuit system for use in an electro-optical device, which can cope with a decreased pixel pitch by using a relatively simple configuration, and also provides an electro-optical device integrating the above type of driving circuit system therein.

A first driving circuit system for use in an electro-optical device according to the present invention is a driving circuit system for use in an electro-optical device for driving pixels, the electro-optical device including switching elements and pixel electrodes connected to the switching elements. The switching elements are disposed in correspondence with intersections of a plurality of scanning lines and a plurality of data lines. The driving circuit system comprises a shift register, formed of a number of stages of unit circuits smaller than the number of the scanning lines, for sequentially outputting a transfer signal from each of the unit circuits based on a clock signal having a predetermined period, and an output circuit that divides the transfer signal output from each of the unit circuits into a plurality of transfer signal components in the time domain, and that sequentially outputs the transfer signal components as scanning signals to the scanning lines.

In the first driving circuit system for use in the electro-optical device according to the present invention, first of all, a transfer signal is sequentially output from each of the unit circuits forming the shift register. The transfer signal is then divided into a plurality of transfer signal components in the time domain by the output circuit, and the transfer signal components are output sequentially to the plurality of scanning lines as scanning signals. Accordingly, with a view to reducing the pixel pitch to a very small size, the circuit pitch of the shift register in relation to the pitch of the scanning lines can be increased in accordance with the number of transfer signal components divided by the output circuit.

For example, conventionally, if the total number of scanning lines is determined to be m (m is an integer, which is two or greater), at least the same m number of unit circuits forming the shift register are required. In contrast, according to the present invention, if the number of transfer signal components divided by the output circuit is n (n is an integer, which is two or greater), only m/n number of unit circuits forming the shift register are required, thereby reducing to 1/n of that of a known art. It is thus possible to increase the circuit pitch of the Y-direction shift register by n times. Additionally, in the present invention, the driving frequency of the shift register can be decreased in accordance with the above-described number n, thereby making it possible to suppress power consumption.

Meanwhile, it is sufficient that the output circuit is configured to divide the transfer signal in the time domain. Thus, the configuration of the output circuit can be made simpler than that of the unit circuits of the shift register. It is thus easy to form the Y-direction circuit pitch required for forming the output circuit smaller than the circuit pitch of the shift register.

According to one aspect of the aforementioned first driving circuit system for use in the electro-optical device, the output circuit may comprise a branching wiring, provided in correspondence with each of the unit circuits, for branching the transfer signal output from the corresponding unit circuit into the plurality of transfer signal components, and an enable circuit, provided in correspondence with each of the transfer signal components branched by the branching wiring, for outputting as the scanning signal an AND signal of each of the transfer signal components and a predetermined enable signal. The enable signals whose active periods do not overlap with each other may be supplied to the enable circuits to which the transfer signal components branched by the same branching wiring are supplied. According to this aspect, each of the transfer signals output from the shift register is branched by each of the plurality of branching wiring patterns. Then, an AND signal of the branched transfer signal component and the enable clock signal is obtained by the corresponding enable circuit, and is supplied to the corresponding scanning line as a scanning signal. Thus, the output circuit can be implemented by a comparatively simple circuit configuration, such as the branching wiring patterns and the enable circuits, thereby easily decreasing the circuit pitch of the output circuit. Hence, the circuit pitch of the enable circuit can be prevented from hampering a decrease in the pixel pitch.

According to the aspect in which the output circuit is provided with the enable circuits, among the enable circuits, the circuits adjacent to the scanning lines may be displaced from each other in the direction in which the data lines are arranged. With this arrangement, the adjacent enable circuits are displaced in the direction in which the scanning lines are arranged (namely, in the direction orthogonal to the direction in which the data lines are formed). Accordingly, the circuit elements forming each enable circuit can be formed with a greater width in the direction in which the scanning lines are arranged compared to the arrangement in which the adjacent enable circuits are aligned alternately along the direction in which the data lines are arranged (namely, linearly along with the direction in which the data lines are arranged). As a result, the circuit pitch of the enable circuits can be further decreased, thereby enhancing a smaller size of the pitch of the scanning lines:

According to the aspect in which the output circuit is provided with the enable circuits, each of the enable circuits may be formed by connecting in series a NAND gate for inputting the transfer signal component and the predetermined enable signal therein, and an inverter for inverting the output of the NAND gate. With this configuration, by using the NAND gate and the inverter connected in series, an AND signal of each of the branched transfer signal component and the enable signal can be reliably output with high precision. Additionally, the configuration of the NAND gate and the inverter is simpler than that of each of the unit circuits of the shift resistor. It is thus relatively easy to decrease the circuit pitch of the enable circuits.

According to the aspect in which the output circuit is provided with the enable circuits, each of the enable circuits may be formed of a transmission gate for outputting the scanning signal when the transfer signal component and the predetermined enable signal are input. With this configuration, since the transmission gate is a relatively simple circuit, the circuit pitch of the enable circuit can be relatively easily decreased. Additionally, the delay time required for generating the scanning signals from the transfer signal components can be decreased.

Alternatively, according to the aspect in which the output circuit is provided with the enable circuits, each of the enable circuits may be formed of a P-channel type or N-channel type thin film transistor for outputting the scanning signal when the transfer signal component and the predetermined enable signal are input. With this configuration, by using a P-channel type or N-channel type thin film transistor, the size of the enable circuit can be made relatively small. It is thus relatively easy to reduce the circuit pitch of the enable circuit. Additionally, since the number of transistors can be made comparatively small, the delay time required for generating the scanning signals from the transfer signal components can be decreased.

According to another aspect of the aforementioned first driving circuit system for use in the electro-optical device, the driving circuit system may be formed at both sides across a portion in which the pixel electrodes are formed, and one of the driving circuit systems may output the scanning signals to the odd-numbered scanning lines, while the other driving circuit system may output the scanning signals to the even-numbered scanning lines. According to this aspect, one of the divided driving circuit systems supplies the scanning signals to the odd-numbered scanning lines, while the other divided driving circuit system supplies the scanning signals to the even-numbered scanning lines. Accordingly, the circuit pitch of the shift register can be doubled. It is thus possible to further reduce the pitch of the scanning lines, in combination with the increased circuit pitch of the shift register in accordance with the number of transfer signal components divided by the output circuit.

An electro-optical device is driven by the above-described first driving circuit system for use in an electro-optical device. According to the electro-optical device, in particular, a decreased pitch of the scanning lines can be achieved by a relatively simple circuit configuration. As the electro-optical device, devices using various electro-optical materials between substrates, such as a liquid crystal device or an EL (Electro Luminescent) device, may be employed.

A second driving circuit system for use in an electro-optical device according to the present invention is a driving circuit system for use in an electro-optical device for driving pixels, the electro-optical device including switching elements and pixel electrodes connected to the switching elements. The switching elements are disposed in correspondence with intersections of a plurality of scanning lines and a plurality of data lines. The driving circuit system comprises a shift register, formed of a number of stages of unit circuits smaller than the number of the data lines, for sequentially outputting a transfer signal from each of the unit circuits based on a clock signal having a predetermined period, an output circuit for dividing the transfer signal output from each of the unit circuits into a plurality of transfer signal components in the time domain, and for outputting the transfer signal components as sampling control signals, and a sampling switch, provided in correspondence with each of the data lines, for sampling an image signal according to the sampling control signals divided by the output circuit, and for supplying the image signal to the corresponding data line.

In the second driving circuit system for use in the electro-optical device according to the present invention, first of all, a transfer signal is sequentially output from each of the unit circuits forming the shift register. The transfer signal is then divided into a plurality of transfer signal components in the time domain by the output circuit, and the transfer signal components are sequentially output to the sampling switches as sampling control signals. Accordingly, with a view to reducing the pixel pitch to a very small size, the circuit pitch of the shift register in relation to the pitch of the data lines can be increased in accordance with the number of transfer signal components divided by the output circuit.

For example, conventionally, if the total number of data lines is determined to be p (p is an integer, which is two or greater), at least the same p number of unit circuits forming the shift register are required. In contrast, according to the present invention, if the number of transfer signal components divided by the output circuit is q (q is an integer, which is two or greater), only p/q number of unit circuits forming the shift register are required, thereby reducing to 1/q of that of a known art. It is thus possible to increase the circuit pitch of the X-direction shift register by q times. Additionally, in the present invention, the driving frequency of the shift register can be decreased in accordance with the above-described number q, thereby making it possible to suppress power consumption. This effect is more noticeable in the data-line driving circuit than the scanning-line driving circuit, since the operating frequency of the data-line driving circuit is much higher than that of the scanning-line driving circuit. Meanwhile, it is sufficient that the output circuit is configured to divide the transfer signal in the time domain. Thus, the configuration of the output circuit can be made simpler than that of the unit circuits of the shift register. It is thus easy to form the X-direction circuit pitch required for forming the output circuit smaller than the circuit pitch of the shift register.

According to one aspect of the second driving circuit system for use in the electro-optical device, the output circuit may comprise a branching wiring, provided in correspondence with each of the unit circuits, for branching the transfer signal output from the corresponding unit circuit into the plurality of transfer signal components, and an enable circuit, provided in correspondence with each of the transfer signal components branched by the branching wiring, for outputting as the sampling control signal an AND signal of each of the transfer signal components and a predetermined enable signal. The enable signals whose active periods do not overlap with each other may be individually supplied to the enable circuits to which the transfer signal components branched by the same branching wiring pattern are supplied. According to this aspect, each of the transfer signals output from the shift register is branched by each of the plurality of branching wiring patterns. Then, an AND signal of the branched transfer signal component and the enable clock signal is obtained by the corresponding enable circuit, and is supplied to the corresponding sampling switch as a sampling control signal. Thus, the output circuit can be implemented by a comparatively simple circuit configuration, such as the branching wiring patterns and the enable circuits, thereby easily decreasing the circuit pitch of the output circuit. Hence, the circuit pitch of the enable circuit can be prevented from hampering a decrease in the pixel pitch.

According to one aspect of the output circuit provided with the enable circuits, each of the enable circuits may be formed by connecting in series a NAND gate for inputting the transfer signal component and the predetermined enable signal therein, and an inverter for inverting the output of the NAND gate. With this configuration, by using the NAND gate and the inverter connected in series, an AND signal of each of the branched transfer signal component and the enable signal can be reliably output with high precision. Additionally, the configuration of the NAND gate and the inverter is simpler than that of each of the unit circuits constituting each stage of shift resistor. It is thus relatively easy to decrease the circuit pitch of the enable circuits.

According to another aspect of the output circuit provided with the enable circuits, each of the enable circuits may be formed of a transmission gate for outputting the sampling control signal when the transfer signal component and the predetermined enable signal are input. With this configuration, since the transmission gate is a relatively simple circuit, the circuit pitch of the enable circuit can be relatively easily decreased. Additionally, the delay time required for generating the sampling control signals from the transfer signal components can be decreased.

An electro-optical device is driven by the above-described second driving circuit system for use in an electro-optical device. According to the electro-optical device, in particular, a decreased pitch of the data lines can be achieved by a relatively simple circuit configuration. As the electro-optical device, devices using various electro-optical materials between substrates, such as a liquid crystal device or an EL device, may be employed.

A third driving circuit system for use in an electro-optical device according to the present invention is a driving circuit system for use in an electro-optical device including switching elements disposed in correspondence with intersections of a plurality of scanning lines and a plurality of data lines, and pixel electrodes connected to the switching elements. The electro-optical device simultaneously samples serial-parallel converted image signals onto a predetermined number of data lines. The driving circuit system comprises a shift register, formed of a number of stages of unit circuits smaller than the number of data lines onto which the image signals are simultaneously sampled, for sequentially outputting a transfer signal from each of the unit circuits based on a clock signal having a predetermined period, an output circuit for dividing the transfer signal output from each of the unit circuits into a plurality of transfer signal components in the time domain, and for outputting the transfer signal components as sampling control signals, and a sampling switch, provided in correspondence with each of the data lines, for sampling one of the image signals according to the corresponding sampling control signal, and for supplying the image signal to the corresponding data line. The sampling switches provided in correspondence with a plurality of adjacent data lines simultaneously sample the different image signals according to the same sampling control signal.

In the third driving circuit system for use in the electro-optical device according to the present invention, first of all, a transfer signal is sequentially output from each of the unit circuits of the shift register. The transfer signal is then divided into a plurality of transfer signal components in the time domain by the output circuit, and the transfer signal components are sequentially output to the sampling switches as sampling control signals. In this case, the sampling switches provided in correspondence with a plurality of adjacent data lines simultaneously sample the different image signals according to the same sampling control signal. Consequently, with a view to reducing the pixel pitch to a very small size, the circuit pitch of the shift register in relation to the pitch of the data lines can be increased in accordance with the number of transfer signal components divided by the output circuit and the number of simultaneously driven sampling switches.

For example, conventionally, if the total number of data lines is determined to be p (p is an integer, which is two or greater), at least the same p number of unit circuits forming the shift register are required. In contrast, according to the present invention, if the number of transfer signal components divided by the output circuit is q (q is an integer, which is two or greater), and if the number of simultaneously driven sampling switches is determined to be r (r is an integer, which is two or greater), only $p/(q\times r)$ number of unit circuits forming the shift register are required, thereby reducing to $1/(q\times r)$ of that of a known art. It is thus possible to increase the circuit pitch of the X-direction shift register by $q\times r$ times. Additionally, in the present invention, the driving frequency of the shift register can be decreased in accordance with the number of transfer signal components divided by the output circuit and the number of simultaneously driven sampling switches, thereby making it possible to suppress power consumption and also to increase the life of the circuit. This effect is more noticeable in the data-line driving circuit than the scanning-line driving circuit, since the operating frequency of the data-line driving-circuit is much higher than that of the scanning-line driving circuit. Meanwhile, it is sufficient that the output circuit is configured to divide the transfer signal in the time domain. Thus, the configuration of the output circuit can be made simpler than that of the unit circuits of the shift register. It is thus easy to form the X-direction circuit pitch required for forming the output circuit smaller than the circuit pitch of the shift register.

According to one aspect of the aforementioned third driving circuit system for use in the electro-optical device, the output circuit may comprise a branching wiring pattern, provided in correspondence with each of the unit circuits, for branching the transfer signal output from the corresponding unit circuit into the plurality of transfer signal components, and an enable circuit, provided in correspondence with each of the transfer signal components branched by the branching wiring pattern, for outputting as the sampling control signal an AND signal of each of the transfer signal components and a predetermined enable signal. The enable signals whose active periods do not overlap with each other may be individually supplied to the enable circuits to which the transfer signal components branched by the same branching wiring pattern are supplied. According to this aspect, each of the transfer signals output from the shift register is branched by each of the plurality of branching wiring patterns. Then, AND signals of the branched transfer signal components and the enable clock signals are obtained by the corresponding enable circuits, and are supplied to the corresponding number of sampling switches as sampling control signals. Thus, the output circuit can be implemented by a comparatively simple circuit configuration, such as the branching wiring patterns and the enable circuits, thereby easily decreasing the circuit pitch of the output circuit. Hence, the circuit pitch of the enable circuit can be prevented from hampering a decrease in the pixel pitch.

According to one aspect of the output circuit provided with the enable circuits, each of the enable circuits may be formed by connecting in series a NAND gate for inputting the transfer signal component and the predetermined enable signal therein, and an inverter for inverting the output of the NAND gate. With this configuration, by using the NAND gate and the inverter connected in series, an AND signal of each of the branched transfer signal component and the enable signal can be reliably output with high precision. Additionally, the configuration of the NAND gate and the inverter is simpler than that of each of the unit circuits forming the shift register. It is thus relatively easy to decrease the circuit pitch of the enable circuits.

According to another aspect of the output circuit provided with the enable circuits, each of the enable circuits may be formed of a transmission gate for outputting the sampling control signal when the transfer signal component and the predetermined enable signal are input. With this configuration, since the transmission gate is a relatively simple circuit, the circuit pitch of the enable circuit can be relatively easily decreased. Additionally, the delay time required for generating the sampling control signals from the transfer signal components can be decreased.

An electro-optical device is driven by the above-described third driving circuit system for use in an electro-optical device. According to the electro-optical device, in particular, a decreased pitch of the data lines can be achieved by a relatively simple circuit configuration. As the electro-optical device, devices using various electro-optical materials between substrates, such as a liquid crystal device or an EL device, may be employed.

A fourth driving circuit system for use in an electro-optical device according to the present invention is a driving circuit system for use in an electro-optical device for driving pixels, the electro-optical device including switching elements and pixel electrodes connected to the switching elements. The switching elements are disposed in correspondence with intersections of a plurality of scanning lines and a plurality of data lines. The driving circuit system comprises a shift register, formed of a number of stages of unit circuits smaller than the number of the data lines, for sequentially outputting a transfer signal from each of the unit circuits based on a clock signal having a predetermined period, an output circuit for dividing the transfer signal output from each of the unit circuits into a plurality of transfer signal components in the time domain or simultaneously distributing the transfer signal into a plurality of transfer signal components, and for outputting the transfer signal components as sampling control signals, and a sampling switch, provided in correspondence with each of the data lines, for sampling an image signal supplied to one of a plurality of image signal lines according to the transfer signal components divided by or distributed by the output circuit, and for supplying the image signal to the corresponding data line.

In the fourth driving circuit system for use in the electro-optical device according to the present invention, first of all, a transfer signal is sequentially output from each of the unit circuits of the shift register. The transfer signal is then divided into a plurality of transfer signal components in the time domain or is simultaneously distributed into a plurality of transfer signal components by the output circuit, and the transfer signal components are output as sampling control signals. In this case, if the transfer signal is divided into a plurality of transfer signal components in the time domain by the output circuit, the individual sampling switches sequentially perform a sampling operation one-by-one. If the transfer signal is simultaneously distributed, the sampling switches provided in correspondence with a plurality of adjacent data lines simultaneously perform a sampling operation. Thus, what is called sequential driving and simultaneous-multiple driving can be switched by the output circuit. Further, in the present invention, the circuit pitch of the shift register in relation to the pitch of the data line can be increased in accordance with the number of transfer signal components divided by the output circuit. Additionally, in the present invention, the driving frequency of the shift register can be reduced to the reciprocal of the number of transfer signal components divided by the output circuit. Meanwhile, it is sufficient that the output circuit is configured to divide the transfer signal in the time domain or to simultaneously distribute the transfer signal. Accordingly, the configuration of the output circuit can be made simpler than that of the unit circuits of the shift register. It is thus easy to form the X-direction circuit pitch required for forming the output circuit smaller than the circuit pitch of the shift register.

According to one aspect of the aforementioned fourth driving circuit system for use in the electro-optical device, when the output circuit divides the transfer signal into the plurality of transfer signal components in the time domain, the same image signal may be supplied to the plurality of image signal lines, and each of the sampling switches may sequentially sample the image signal. When the output circuit simultaneously distributes the transfer signal into the plurality of transfer signal components, a single-type image signal may be expanded by a plurality of times in the time domain and may be distributed onto the plurality of image signal lines to the plurality of image signal lines. Among the sampling switches, the adjacent sampling switches provided in correspondence with a plurality of adjacent data lines may simultaneously sample the image signals. With this configuration, when the transfer signal is divided into a plurality of transfer signal components in the time domain, the same image signal is supplied to a plurality of image signal lines, thereby enabling sequential driving. When the transfer signal is simultaneously distributed into a plurality of transfer signal components, a single-type image signal is expanded to image signals by a plurality of times in the time domain, and the image signals are supplied to the plurality of image signal lines, thereby enabling simultaneous-multiple driving.

According to another aspect of the aforementioned fourth driving circuit system for use in the electro-optical device, the output circuit may comprise a branching wiring pattern, provided in correspondence with each of the unit circuits, for branching the transfer signal output from the corresponding unit circuit into the plurality of transfer signal components, and an enable circuit, provided in correspondence with each of the transfer signal components branched by the branching wiring pattern, for outputting as the sampling control signal an AND signal of each of the transfer signal components and a predetermined enable signal. When the transfer signal is divided into the plurality of transfer signal components in the time domain, the enable signals whose active periods do not overlap with each other during a cycle in which the transfer signal components branched by the same branching wiring pattern are supplied may be individually supplied to the enable circuits to which the transfer signal components branched by the same branching wiring pattern are supplied. When the transfer signal is simultaneously distributed into the transfer signal components, the enable signals whose active periods are in phase during a cycle in which the transfer signal components branched by the same branching wiring pattern are supplied may be individually supplied to the enable circuits to which the transfer signal components branched by the same branching wiring pattern are supplied. According to this aspect, each of the transfer signals output from the shift register is branched by the plurality of branching wiring patterns. An AND signal of the branched transfer signal component and an enable clock signal is obtained by the enable circuit, and is supplied to the corresponding sampling switch as a sampling control signal. Thus, since the output circuit can be implemented by a comparatively simple circuit configuration, such as the branching wiring pattern and the enable circuit, the circuit pitch of the output circuit can be easily reduced. Accordingly, the circuit pitch can be prevented from hampering a reduction in the pixel pitch.

In one aspect of the output circuit provided with the enable circuits, each of the enable circuits may be formed by connecting in series a NAND gate for inputting the transfer signal component and the predetermined enable signal therein, and an inverter for inverting the output of the NAND gate. With this configuration, by using the NAND gate and the inverter connected in series, the AND signal of the branched transfer signal component and the enable signal can be reliably output with high precision. Also, since the NAND gate and the inverter are simpler than the unit circuits of the shift register, the circuit pitch of the enable circuit can be relatively easily decreased.

In another aspect of the output circuit provided with the enable circuits, each of the enable circuits may be formed of a transmission gate for outputting the sampling control signal when the transfer signal component branched by the branching wiring pattern and the predetermined enable signal are input. With this configuration, since the transmission gate is relatively a simple circuit, it is comparatively easy to reduce the circuit pitch of the enable circuit. Additionally, the delay time required for generating the sampling control signal from the transfer signal can be shortened.

An electro-optical device is driven by the above-described fourth driving circuit system. According to the electro-optical device, in particular, a decreased pitch of the data lines can be achieved by a relatively simple circuit configuration. As the electro-optical device, devices using various electro-optical materials between substrates, such as a liquid crystal device or an EL device, may be employed.

According to one aspect of the electro-optical device, the electro-optical device may comprise determining means for making a determination of whether the transfer signal is divided into the plurality of transfer signal components in the time domain or is simultaneously distributed into the plurality of transfer signal components in the output circuit, and supplying means for individually supplying the enable signals whose active periods do not overlap with each other during a cycle in which the transfer signal components branched by the same branching wiring pattern are supplied to enable circuits to which the transfer signal components branched by the same branching wiring pattern are supplied when it is determined that the transfer signal is divided into the plurality of transfer signal components in the time domain. The supplying means individually supplies the enable signals whose active periods are in phase during a cycle in which the transfer signal components branched by the same branching wiring pattern are supplied to the enable circuits to which the transfer signal components branched by the same branching wiring pattern are supplied when it is determined that the transfer signal is simultaneously distributed into the plurality of transfer signal components. According to this aspect, the determining means determines whether sequential driving or simultaneous-multiple driving is employed, and the enable signal required for the determined type of driving is supplied to the enable circuit by the supplying means.

In one aspect of the electro-optical device provided with the determining means and the supplying means, the determining means may make the determination based on the type of the input image signal. For example, if the image signal is a video-type signal, such as an NTSC, PAL, or SECAM signal, the determining means determines that the transfer signal is to be divided into a plurality of transfer signal components in the time domain, thereby performing sequential driving. On the other hand, if the image signal is a data-type signal, such as a signal from a personal computer, the determining means determines that the transfer signal is simultaneously distributed into a plurality of transfer signal components, thereby performing simultaneous-multiple driving.

In another aspect of the electro-optical device provided with the determining means and the supplying means, the electro-optical device may further comprise a motion detector for detecting motion included in the input image signal and for outputting a detection signal. The determining means may determine that the transfer signal is to be divided into the plurality of transfer signal components in the time domain when it has determined, based on the detection signal, that the motion has been detected in the input image signal within a predetermined period. The determining means may determine that the transfer signal is to be simultaneously distributed into the plurality of transfer signal components when it has determined that the motion has not been detected in the input image signal within the predetermined period. According to this aspect, sequential driving and simultaneous-multiple driving are switched according to motion included in the image signal, thereby making it possible to drive the individual data lines. That is, sequential driving is performed on an image with rapid motion, resulting in the regularity of the image, while simultaneous-multiple driving is performed on an image with no (or less) motion, resulting in high-definition display. Thus, the optimal driving type in response to the characteristics of the image to be displayed can be selected to output the image.

A fifth driving circuit system for use in an electro-optical device according to the present invention is a driving circuit system for use in an electro-optical device for driving pixels, the electro-optical device including switching elements and pixel electrodes connected to the switching elements. The switching elements are disposed in correspondence with intersections of a plurality of scanning lines and a plurality of data lines. The driving circuit system comprises a shift register, formed of a number of stages of unit circuits smaller than the number of the data lines, for sequentially outputting a transfer signal from each of the unit circuits based on a clock signal having a predetermined period, a first output circuit for dividing the transfer signal output from each of the unit circuits into a plurality of transfer signal components in the time domain, a second output circuit for further dividing each of the transfer signal components divided by the first output circuit into a plurality of transfer signal portions in the time domain or simultaneously distributing each of the transfer signal components into a plurality of transfer signal portions, and for outputting the transfer signal portions as sampling control signals, and a sampling switch, provided in correspondence with each of the data lines, for sampling an image signal supplied to one of a plurality of image signal lines in accordance with the transfer signal portion divided or distributed by the second output circuit, and for supplying the image signal to the corresponding data line.

In the fifth driving circuit system for use in the electro-optical device according to the present invention, first of all, a transfer signal is sequentially output by each of the unit circuits of the shift register. The transfer signal is then divided into a plurality of transfer signal components in the time domain by the first output circuit. The divided transfer signal component is further divided into a plurality of transfer signal portions in the time domain or is simultaneously distributed into a plurality of transfer signal portions by the second output circuit, and the transfer signal portions are output as sampling control signals. Thus, with a view to reducing the pixel pitch to a very small size, the circuit pitch of the shift register in relation to the pitch of the data lines can be increased in accordance with the number of transfer signal components divided by the first output circuit and the number of transfer signal portions divided by the second output circuit.

For example, conventionally, if the total number of data lines is determined to be p (p is an integer, which is two or greater), at least the same p number of unit circuits forming the shift register are required. In contrast, according to the present invention, if the number of transfer signal components divided by the first output circuit is q (q is an integer, which is two or greater), and if the number of transfer signal portions divided by the second output circuit is s (s is an integer, which is two or greater), only $p/(q \times s)$ number of unit circuits forming the shift register are required, thereby reducing to 1/(q×s) of that of a known art. It is thus possible to increase the circuit pitch of the X-direction shift register by q×s times. Additionally, in the present invention, the driving frequency of the shift register can be decreased in accordance with the product of the number of transfer signal components and the number of transfer signal portions. This effect is more noticeable in the data-line driving circuit than the scanning-line driving circuit, since the operating frequency of the data-line driving circuit is much higher than that of the scanning-line driving circuit.

Meanwhile, it is sufficient that the first output circuit is configured to divide the transfer signal in the time domain and that the second output circuit is configured to divide the transfer signal component in the time domain or simultaneously distribute the transfer signal component. Thus, the configurations of the first output circuit and the second output circuit can be made simpler than that of the unit circuits of the shift register. It is thus easy to form the X-direction circuit pitch required for forming the first and second output circuits, in particular, the second output circuit, which correspond to the scanning lines, smaller than the circuit pitch of the shift register.

Further, in the present invention, when the second output circuit divides the transfer signal component into a plurality of transfer signal portions in the time domain, the individual sampling switches perform a sampling operation in turn one-by-one. When the second output circuit simultaneously distributes the transfer signal component, a plurality of sampling switches provided in correspondence with a plurality of adjacent data lines simultaneously perform a sampling operation. Consequently, what is called sequential driving and simultaneous-multiple driving can be switched by the second output circuit.

According to one aspect of the fifth driving circuit system for use in the electro-optical device, the first output circuit may comprise a first branching wiring pattern, provided in correspondence with each of the unit circuits, for branching the transfer signal output from the corresponding unit circuit into the plurality of transfer signal components, and a first enable circuit, provided in correspondence with each of the transfer signal components branched by the first branching wiring pattern, for outputting an AND signal of the transfer signal component branched by the first branching wiring pattern and an enable signal belonging to a first group. The enable signals belonging to the first group whose active periods do not overlap with each other during a cycle in which the transfer signal components branched by the same first branching wiring pattern are supplied are individually supplied to the first enable circuits to which the transfer signal components branched by the same first branching wiring pattern are supplied. The second output circuit may comprise a second branching wiring pattern, provided in correspondence with each of the first enable circuits, for branching each of the transfer signal components divided by the corresponding first enable circuit into the plurality of transfer signal portions, and a second enable circuit, provided in correspondence with each of the transfer signal portions branched by the second branching wiring pattern, for outputting as a sampling control signal an AND signal of the transfer signal portion branched by the second branching wiring pattern and an enable signal belonging to a second group. When the transfer signal component is divided into the plurality of transfer signal portions in the time domain, the enable signals belonging to the second group whose active periods do not overlap with each other during a cycle in which the transfer signal portions branched by the same second branching wiring pattern are supplied are individually supplied to the second enable circuits to which the transfer signal portions branched by the same second branching wiring pattern are supplied. When the transfer signal component is simultaneously distributed into the plurality of transfer signal portions, the enable signals belonging to the second group whose active periods are in phase during a cycle in which the transfer signal portions branched by the same second branching wiring pattern are supplied are individually supplied to the second enable circuits to which the transfer signal portions branched by the same second branching wiring pattern are supplied. According to this aspect, the transfer signal output from the shift register is first branched by each of a plurality of first branching wiring patterns, and an AND signal of the transfer signal component and an enable signal belonging to the first group is obtained by the first enable circuit. The AND signal is further branched by each of a plurality of second branching wiring patterns. An AND signal of the above AND signal and an enable signal belonging to the second group is obtained by the second enable circuit, and is supplied to the corresponding sampling switch as a sampling control signal. Accordingly, the first output circuit can be implemented by a relatively simple circuit configuration, such as the first branching wiring patterns and the first enable circuits. Similarly, the second output circuit can be implemented by a relatively simple circuit configuration, such as the second branching wiring patterns and the second enable circuits. Thus, the circuit pitches of the first and second output circuits can be easily decreased. As a consequence, the circuit pitches of the first and second output circuits can be prevented from hampering a decrease in the pixel pitch.

An electro-optical device is driven by the above-described fifth driving circuit system. According to the electro-optical device, in particular, a decreased pitch of the data lines can be achieved by a relatively simple circuit configuration. As the electro-optical device, devices using various electro-optical materials between substrates, such as a liquid crystal device or an EL device, may be employed.

DETAILED DESCRIPTION OF PREFERRED EMBODIMENTS

Embodiments of the present invention are described hereinbelow with reference to the drawings. In the embodiments described below, a liquid crystal device using liquid crystal as an electro-optical material, namely, an active-matrix-type liquid crystal device driven by TFTs, is discussed as an example of the electro-optical device. However, this is by no means intended to limit the invention.

Figure 1:
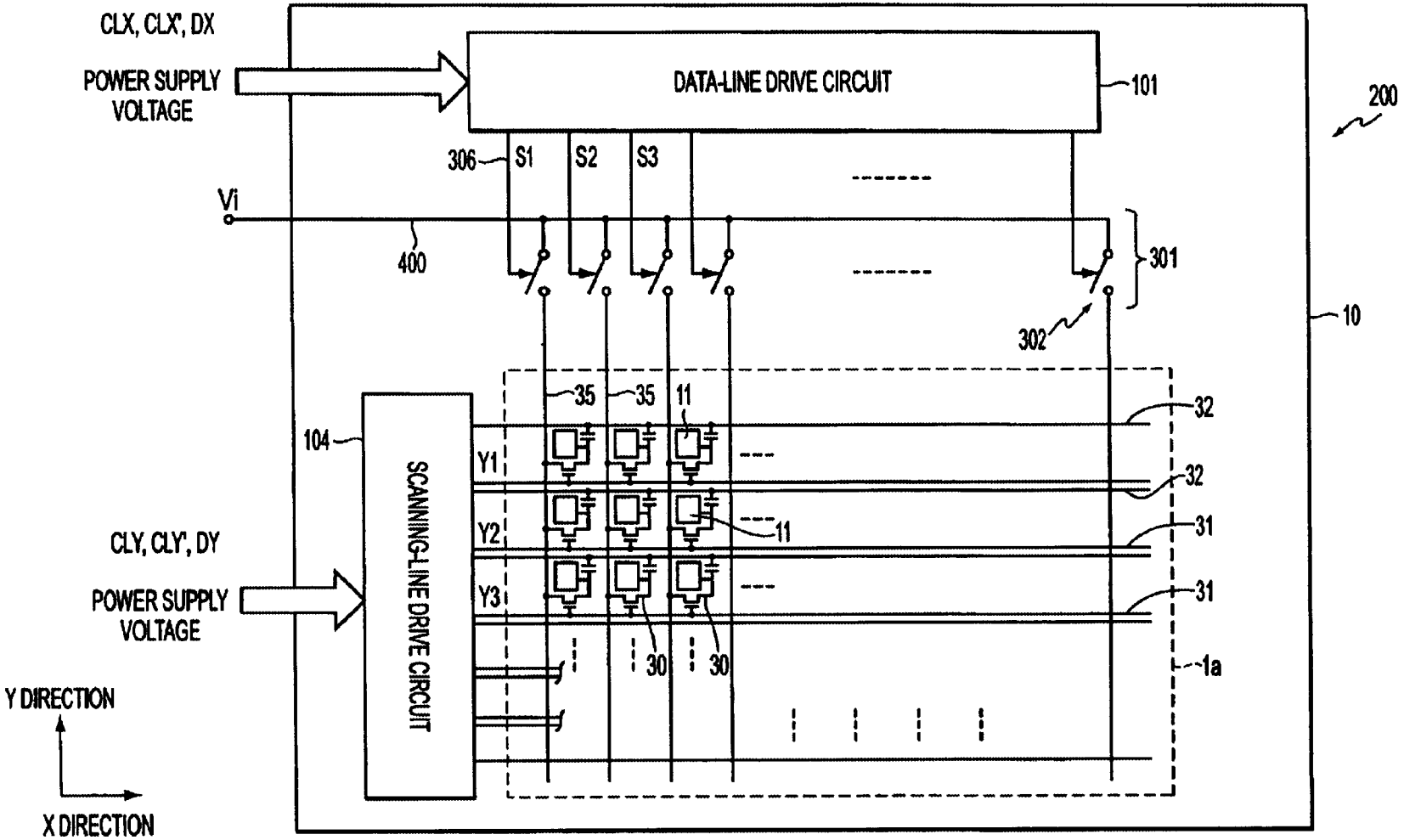
FIG. 1 is a block diagram illustrating the overall configuration of a liquid crystal device according to a first embodiment of the present invention.

A description is first given of a first embodiment. FIG. 1 is a block diagram illustrating the entire configuration of an electro-optical device provided with a driving circuit system of this embodiment on a substrate. In this figure, a liquid crystal device 200 includes a liquid crystal display portion 1*a*, a data-line driving circuit 101, a scanning-line driving circuit 104, a sampling circuit 301, and so on.

Among the above-described elements, the data-line driving circuit 101, the scanning-line driving circuit 104, and the sampling circuit 301 are provided at the peripheral portion of the liquid crystal display portion 1*a* on a TFT array substrate 10, formed of, for example, a quartz substrate, hard glass, or a silicon substrate. On the liquid crystal display portion 1*a* on the TFT array substrate 10, a plurality of data lines 35 are formed parallel to each other in the Y direction, as viewed from FIG. 1, while a plurality of scanning lines 31 are formed in the X direction, as viewed from FIG. 1. Additionally, pixel electrodes 11 are disposed corresponding to the respective intersecting portions of the data lines 35 and the scanning lines 31. Accordingly, the pixel electrodes 11 are arranged in a matrix in the X direction and in the Y direction. TFTs 30 are connected to the respective pixel electrodes 11 so as to set a conducting state or a non-conducting state between the pixel electrodes 11 and the data lines 35 in accordance with a scanning signal supplied via the scanning lines 31. Further, capacitor lines (storage capacitor electrodes) 32 are formed on the TFT array substrate 10 parallel to the scanning lines 31 so as to form a storage capacitor for storing voltages to be applied to the pixel electrodes 11 for a long period.

The data-line driving circuit 101, which serves as a driving circuit for the data lines 35 (X direction), sequentially generates sampling control signals based on a lock signal CLX (and its inverted clock CLX'), namely, an X-direction reference lock signal, and outputs them to corresponding sampling control signal lines 306.

The sampling circuit 301 is formed of sampling switches 302 provided for the corresponding data lines 35. Each of the sampling switches 302 is connected at one end to the corresponding data line 35 and at the other end to an image signal line 400 which is used in common for all the sampling switches 302. The sampling switches 302 are closed at both ends by the sampling control signals supplied via the corresponding sampling control signal lines 306. With this arrangement, upon sequentially and exclusively supplying the sampling control signals to the respective sampling control signal lines 306, the sampling switches 302 sample an image signal Vi supplied to the image signal line 400 in turns, so that the image signal Vi is sequentially applied to each of the data lines 35, which will be described later.

Meanwhile, the scanning-line driving circuit 104, which serves as a driving circuit for the scanning lines 31 (Y direction), sequentially generates scanning signals based on a clock signal CLY (and its inverted clock CLY'), i.e., a Y-direction reference clock signal, and outputs them to the respective scanning lines 31.

Figure 2:
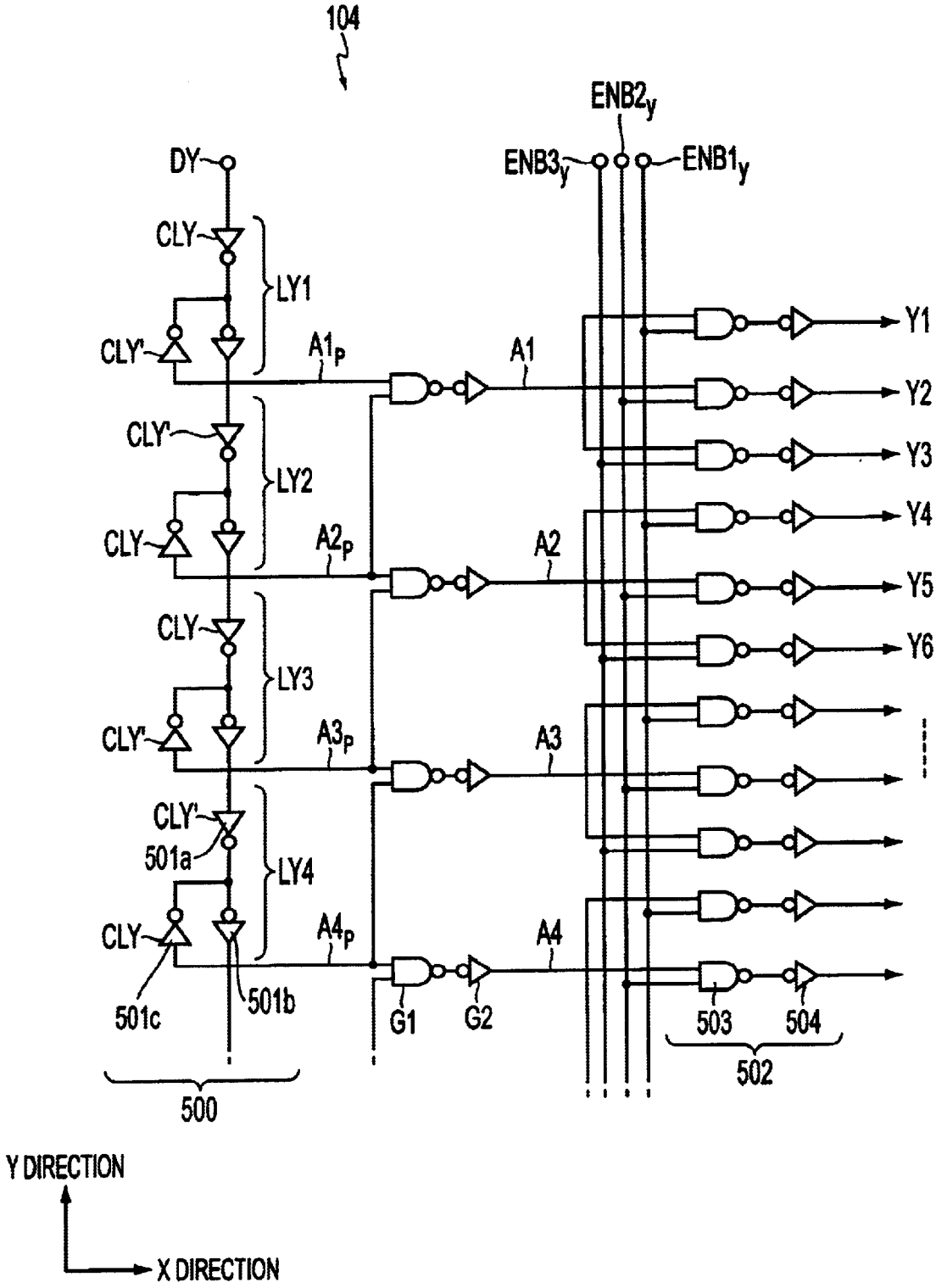
FIG. 2 is a circuit diagram illustrating the configuration of a scanning-line driving circuit for use in the liquid crystal device shown in FIG. 1.

The aforementioned scanning-line driving circuit 104 is described below in detail. FIG. 2 is a block diagram illustrating the configuration of the scanning-line driving circuit 104. In FIG. 2, a shift register 500 is configured in such a manner that unit circuits LY1, LY2, . . . operated in response to the clock signals CLY and their inverted clock signals CLY' are cascade-connected in multiple stages. The clock signal CLY is supplied from an external image signal processing circuit, the frequency of the signal CLY being the same as the horizontal scanning frequency. The inverted clock signal CLY' is obtained by inverting the levels of the clock signal CLY, and is also supplied from the external image signal processing circuit. Further, a start pulse DY is supplied to the unit circuit LY1 of the initial stage from the external image signal processing circuit at the start of the vertical scanning period. Each of the other unit circuits receives a transfer signal passed from the previous unit circuit (from the upper unit circuit as viewed from FIG. 2).

Among the unit circuits, the odd-numbered stages of the unit circuits LY1, LY3, . . . , which are numbered from the uppermost unit circuit, read an input signal at the rising edge of the clock signal CLY and output it. On the other hand, the even-numbered stages of the unit circuits LY2, LY4, . . . , which are numbered from the uppermost unit circuit, read an input signal at the rising edge of the inverted clock signal CLY' and output it.

Figure 3:
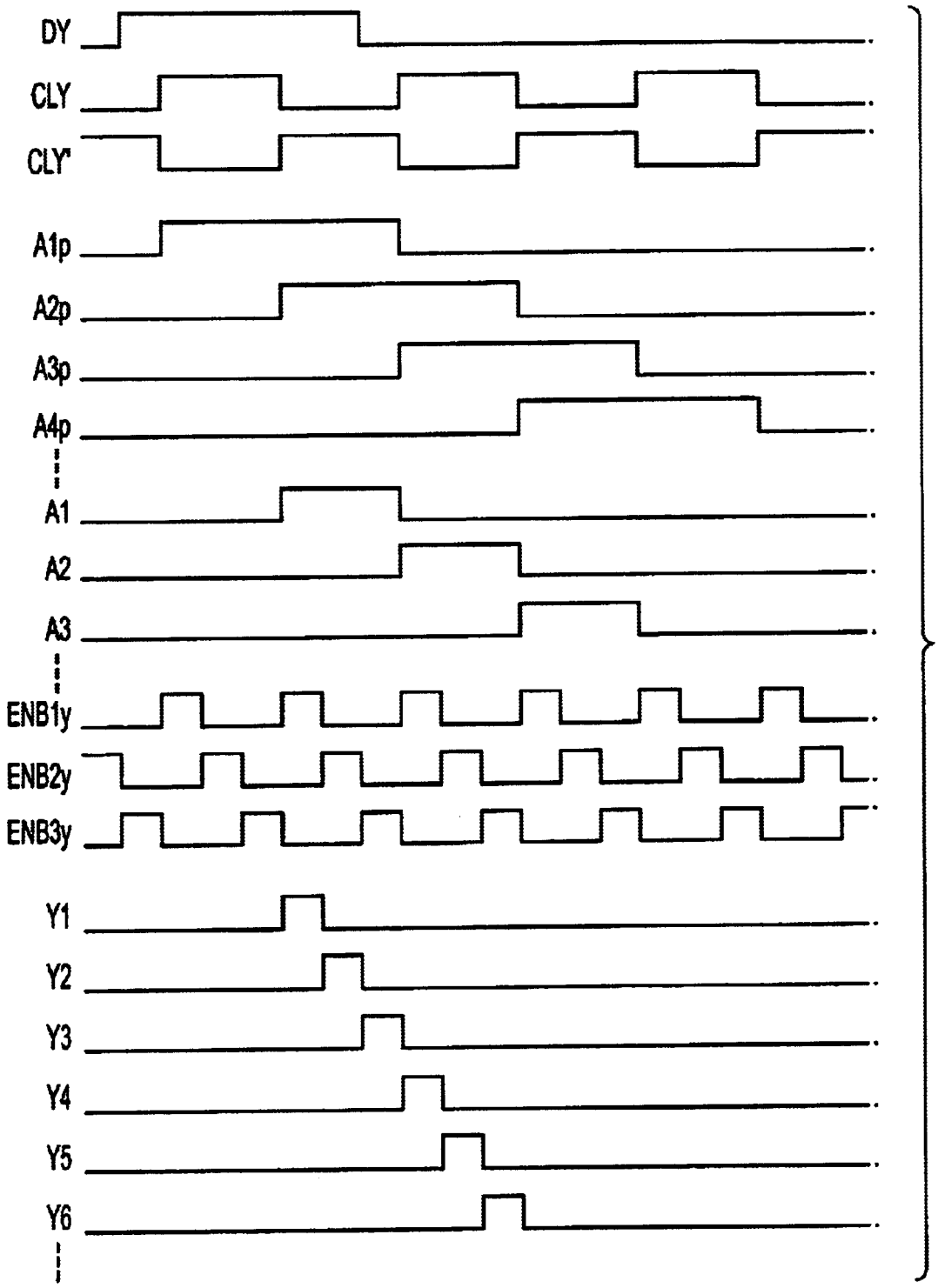
FIG. 3 is a timing chart illustrating the operation of the scanning-line driving circuit shown in FIG. 1.

Consequently, output signals A1p, A2p, . . . of the respective unit circuits LY1, LY2, . . . are output, as shown in FIG. 3. More specifically, the output-signal A1p of the initial-stage unit circuit LY1 is generated by reading the start pulse DY at the rising edge of the clock signal CLY, and the output signals A2p, A3p, A4p, . . . of the subsequent unit circuits LY2, LY3, LY4, . . . , respectively, are obtained by sequentially delaying the output signal A1p by half a period of the clock signal CLY (the inverted clock signal CLY').

In FIG. 2, each unit circuit is formed of a clocked inverter 501*a* for inverting the input signal, an inverter 501*b* for re-inverting the inverted signal, and a clocked inverter 501*c* for feeding back the re-inverted signal to the input of the inverter 501*b*. The clocked inverters 501 a of the odd-numbered unit circuits invert the input signal when the clock signal CLY is at an H level (when the inverted clock signal CLY' is at an L level). The clocked inverters 501*c* of the odd-numbered unit circuits invert the input signal when the clock signal CLY is at the L level (when the inverted clock signal CLY' is at the H level). In contrast, the levels of the clock signal when the even-numbered unit circuits invert the input signal are reversed to those when the odd-numbered unit circuits invert the input signal.

Figure 4A:
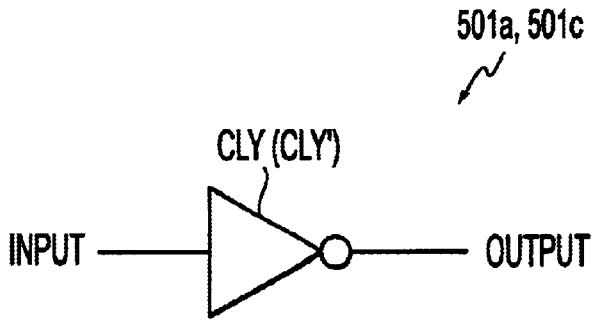
FIG. 4(*a*) illustrates a clocked inverter, and FIG. 4(*b*) illustrates a circuit diagram illustrating the specific configuration of the clocked inverter.
Figure 4B:
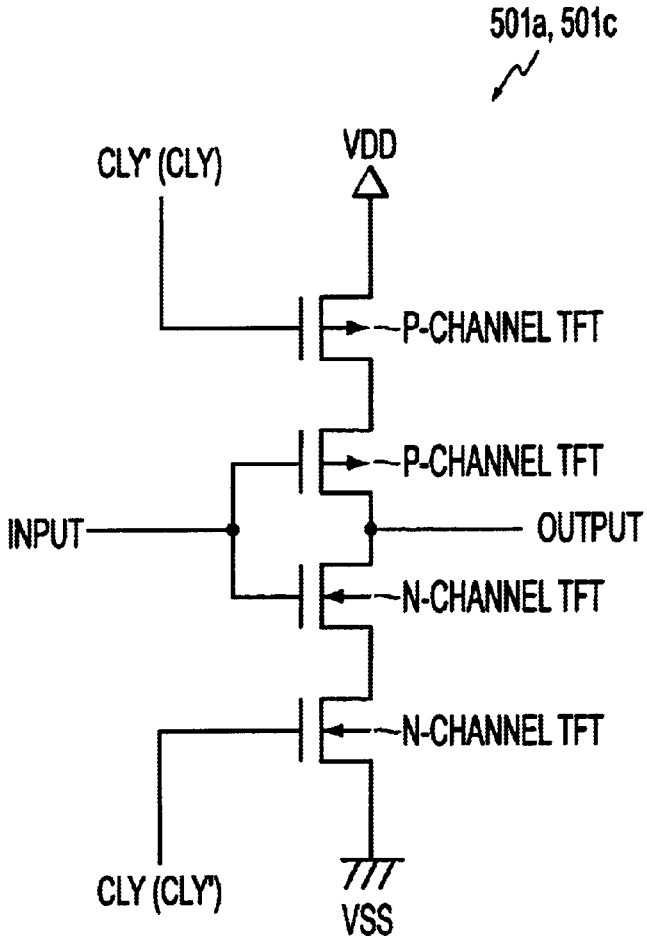

To specifically indicate the configuration of the clocked inverter 501*a* or 501*c* shown in FIG. 2, the general configuration of the inverter 501*a* or 501*c* is shown in FIG. 4(*a*), and the specific configuration of the inverter 501*a* or 501*c* is shown in FIG. 4(*b*). More specifically, the inverter 501*a* or 501*c* to which the clock signal CLY is supplied, as shown in FIG. 4(*a*), is configured, as illustrated in FIG. 4(*b*), such that a P-channel TFT for inputting the inverted clock signal CLY' into its gate electrode, a complimentary P-channel TFT and a complimentary N-channel TFT for respectively inputting the input signal into their gate electrodes, and an N-channel TFT for inputting the clock signal CLY into its gate electrode are connected in series to each other between a high-potential power source VDD and a low-potential power source VSS. If the inverted clock signal CLY' is supplied to the inverter 501*a* or 501*c*, as indicated by the parentheses of FIG. 4(*a*), the relationship of the clock signal CLY and the inverted clock signal CLY' is reversed, as indicated by the parentheses of FIG. 4(*b*).

Referring back to FIG. 2, the output terminal of each of the unit circuits LY1, Y2, . . . is provided with a NAND gate G1 and an inverter G2 connected in series to each other. Among these elements, the NAND gate G1 outputs a NAND signal of a transfer signal from the corresponding unit circuit and a transfer signal from the subsequent-stage unit circuit (the lower unit circuit as viewed from FIG. 2), and the inverter G2, which is located at the output terminal of the NAND gate G1, outputs the inverted NAND signal.

Accordingly, transfer signals A1, A2, . . . output from the respective stages of the inverters G2 are generated, as shown in FIG. 3. More specifically, the transfer signals A1, A2, . . . become the H level during the period in which the transfer signal from the corresponding unit circuit and the transfer signal from the subsequent-stage unit circuit overlap. Thus, the transfer signals A1, A2 . . . become the H level in turn while being exclusive from each other.

Referring back to FIG. 2 once again, the transfer signals A1, A2 . . . output front the respective stages of inverters G2 are branched off into a plurality of (three in this embodiment) components. Each branched component is provided with an enable circuit 502 formed by connecting a NAND gate 503 and an inverter 504 in series to each other. This enable circuit 502 is provided in correspondence with one scanning line 31 (see FIG. 1), and the output signal from the enable circuit 502 is supplied to the corresponding scanning line 31 as a scanning signal.

In the NAND gate 503, which forms a portion of the enable circuit 502, the branched transfer signal component is supplied to one input terminal of the NAND gate 503, and one of the enable signals ENB1y, ENB2y, and ENB3y is supplied to the other input terminal. More specifically, the type of enable signal supplied to the other input-terminal of the j-th NAND gate 503 numbered from the uppermost NAND gate 503 is calculated as follows. If the remainder obtained by dividing j by three is one, the enable signal ENB1y is supplied. If the remainder obtained by dividing j by three is two, the enable signal ENB2y is supplied. If the remainder obtained by dividing j by three is zero, the enable signal ENB3y is supplied.

The enable signals ENB1y, ENB2y, and ENB3y, which ate supplied from, for example, an external image signal processing circuit, respectively have waveforms illustrated in FIG. 3. That is, the enable signals ENB1y, ENB2y, and ENB3y have a frequency two times higher than the clock signal CLY (inverted clock signal CLY'). The pulse widths of the enable signals are approximately one third of that of the clock signal CLY (inverted clock signal CLY'), and the pulse-width cycles of the respective enable signals are sequentially shifted from each other without overlapping.

Accordingly, scanning signals Y1, Y2, . . . output from the respective enable circuits 502 are generated, as shown in FIG. 3. More specifically, the transfer signal A1 is first sequentially divided into three components in the time domain in accordance with the enable signals ENB1y, ENB2y, and ENB3y so as to generate scanning signals Y1, Y2, and Y3, respectively. Similarly, the transfer signal A2 is then sequentially divided into three components in the time domain in accordance with the enable signals ENB1y, ENB2y, and ENB3y so as to generate scanning signals Y4, Y5, and Y6. Thereafter, a dividing operation similar to that described above is repeated.

As a consequence, during one vertical scanning period, the scanning signals Y1, Y2, Y3 . . . are output in turn while being exclusive from each other, so that the scanning lines 31 are alternately selected one-by-one from the uppermost scanning line 31, and the TFTs 30 connected to the corresponding scanning lines 31 are activated.

The scanning-line driving circuit 104 constructed as described above generates scanning signals by sequentially dividing each of the transfer signals A1, A2, A3, . . . output from the unit circuits of the shift register 500 into three components in the time domain. Accordingly, the number of stages of unit circuits is only one-third the total number of scanning lines 31, which is the reciprocal of the number of divided components of each transfer signal. Thus, the unit circuits, which form the shift register 500, can be formed at a pitch three times as wide as the pitch of the scanning lines 31 in the Y direction.

Although the provision of the enable circuit 502 is required for each scanning line 31, it is easy to form the enable circuits 502 with a narrow pitch since the enable circuit 502 can be formed by simply connecting the NAND gate 503 and the inverter 504 in series to each other. For example, it is now assumed that the smallest possible Y-direction pitch of the unit circuits of the shift register 500 be, for example, approximately 23 $\mu$m. Then, if the NAND gate 503 and the inverter 504 are formed by using a microfabrication technique that is comparable to that employed for forming the unit circuits, the Y-direction pitch of the enable circuits 502 can be reduced to approximately 15 to 18 $\mu$m.

According to the scanning-line driving circuit 104, the Y-direction pitch of the unit circuits of the shift register 500 can be prevented from hampering a reduction in the pitch of the scanning lines. It is thus possible to form the pitch of the scanning lines narrower than the smallest possible Y-direction pitch of the unit circuits.

Additionally, the operating frequency of the shift register 500 is reduced to one third, which is the reciprocal of the number of divided components of each transfer signal of the enable circuits 502. Accordingly, it is not demanded that the clocked inverters 501 a and 501*c*, and the inverter 501*b* of the shift register 500 exhibit very good characteristics. This further relaxes the specifications of the shift register 500, such as the circuit precision, the circuit scale, the wiring resistance, the time constant, the capacitance, the delay time, and the like.

In FIG. 2, although the scanning-line driving circuit 104 is configured such that each of the transfer signals A1, A2, . . . is divided into three components, the present invention is not limited to this configuration. The transfer signals A1, A2, . . . may be divided into two, four or a greater number. However, with a smaller number of divided signal components, it is more likely that the pitch of the scanning lines should be dependent upon the Y-direction pitch of the unit circuits. On the other hand, according to this embodiment, the pitch of the scanning lines cannot be made narrower than the smallest possible Y-direction pitch of the enable circuits 502. Thus, with an excessively large number of divided signal components, the number of signal lines for supplying the enable signals is increased, which makes the wiring step more complicated. In practice, therefore, it is desirable that the number of divided components of a transfer signal be set by considering various circumstances.

Although the enable circuit 502 shown in FIG. 2 is formed by connecting the NAND gate 503 and the inverter 504 in series to each other, various configurations of the enable circuit 502 may be employed in the present invention. Accordingly, another example of the configuration of the enable circuit is now discussed.

Figure 5A:
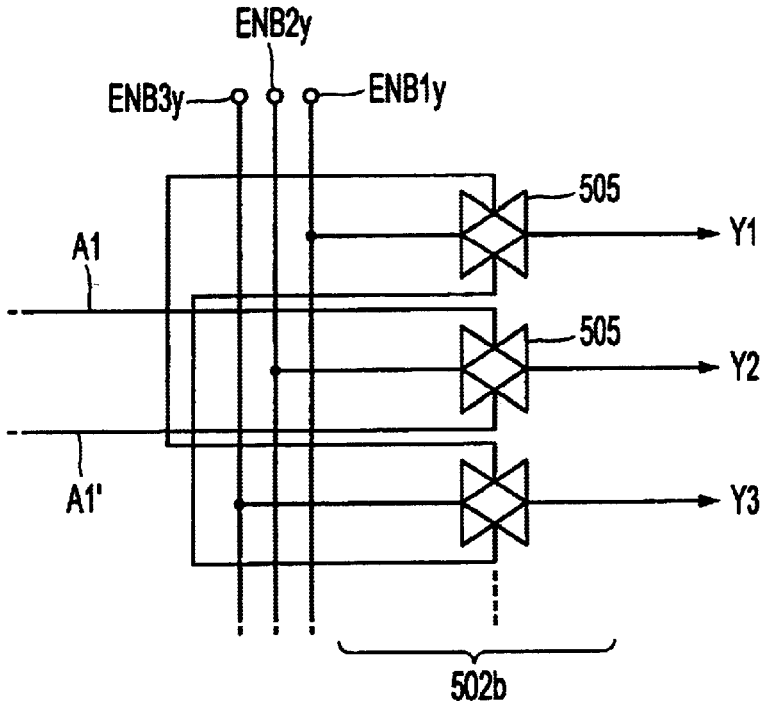
FIG. 5(*a*) is a circuit diagram illustrating an example of modifications of the scanning-line driving circuit (or the data-line driving circuit), FIG. 5(*b*) is a circuit diagram illustrating an example of the specific configuration of a transmission gate, and FIG. 5(*c*) is a circuit diagram illustrating another example of the transmission gate.
Figure 5B:
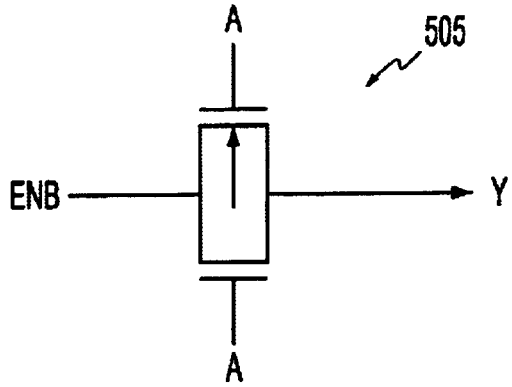
Figure 5C:
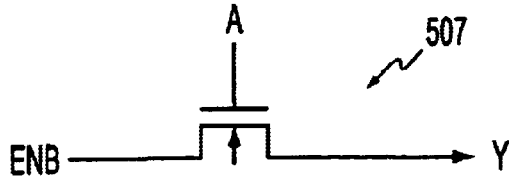

In an enable circuit 502*b* shown in FIG. 5(*a*), the NAND gate 503 and the inverter 504 connected in series are substituted for by a transmission gate 505. That is, the transmission gate 505 is used for dividing a branched transfer signal component according to one of the enable signals ENB1y, ENB2y, and ENB3y and supplying the divided signal component as a scanning signal. Accordingly, as in the case of the NAND gate 503 and the inverter 504 connected in series, the transmission gate 505 is provided for each scanning line 31.

As the transmission gate 505, for example, the configuration in which a P-channel TFT and an N-channel TFT complimentarily connected to each other, as illustrated in FIG. 5(*b*), may be used. In this case, it is necessary to supply to each of the TFTs two types of transfer signals having levels inverted with respect to each other. Accordingly, in addition to the branched transfer signal A1, the inverted transfer signal A1' is supplied to, for example, each of the first to the third transmission gates 505 numbered from the uppermost transmission gate 505. The same applies to the transmission gates 505 to which the transfer signals A2, A3, . . . are supplied.

FIG. 5(*b*) illustrates the configuration of the j-th transmission gate 505 numbered from the uppermost transmission gate 505. The transfer signal and the enable signal supplied to this transmission gate 505 are similar to those supplied to the NAND gate 503 (see FIG. 2).

As stated above, according to the enable circuit 502*b* formed by the transmission gates 505 provided for the respective scanning lines 31, only two TFTs are required for each transmission gate 505, thereby making it possible to reduce the Y-direction pitch of the enable circuit 502*b* to an even smaller size. For example, if the Y-direction pitch of the enable circuit 502 shown in FIG. 2 is approximately 18 $\mu$m, the Y-direction pitch of the enable circuit 502*b* using the transmission gate 505 is further reduced to approximately 12 to 16 $\mu$m. Additionally, since the number of components for the transmission gate 505 is two, the delay time required for generating the scanning signal from the branched transfer signal in the enable circuit 502*b* can be advantageously decreased.

In the enable circuit 502*b*, instead of the transmission gate 505 shown in FIG. 5(*b*), an N-channel TFT shown in FIG. 5(*c*), namely, an N-channel TFT 507, which opens or closes in response to the transfer signal, may be used. Alternatively, a P-channel TFT, which opens or closes in response to the inverted transfer signal, may be used. That is, the enable circuit may be configured by either an N-channel or P-channel TFT rather than by complimentary TFTs. In this manner, according to the enable circuit formed by either an N-channel or P-channel TFT, the number of components is further reduced (to one). Also, since only one type of transfer signal is supplied to the TFT's gate, the Y-direction pitch of the enable circuit can be further decreased. Also, the delay time required for generating the scanning signal from the branched transfer signal can be advantageously reduced.

The arrangement of the enable circuit is now discussed. The enable circuits illustrated in FIG. 2 and FIG. 5(*a*) are aligned in the Y direction. In practice, however, the above-described arrangement of the enable circuits is not suitable for decreasing the Y-direction pitch. Then, more practical arrangements of the enable circuits which are favorable for decreasing the Y-direction pitch are described.

Figure 6A:
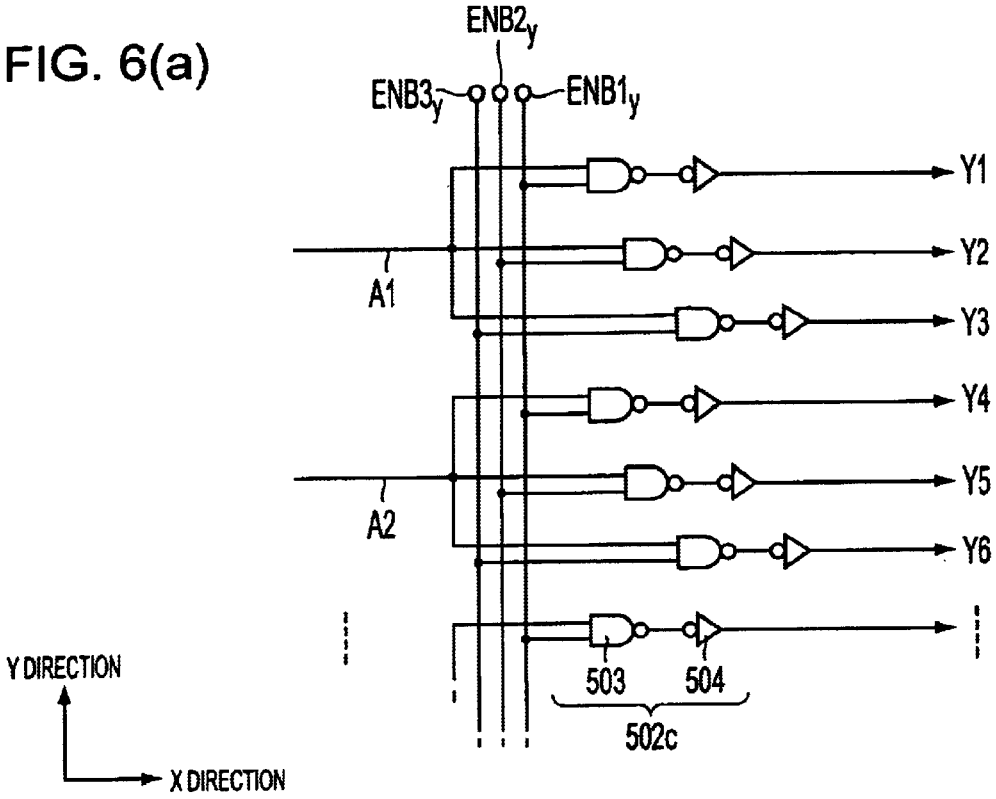
FIG. 6(*a*) illustrates an example of the arrangement of enable circuits for use in the scanning-line driving circuit (or the data-line driving circuit), and FIG. 6(*b*) illustrates another example of the arrangement of the enable circuits.
Figure 6B:
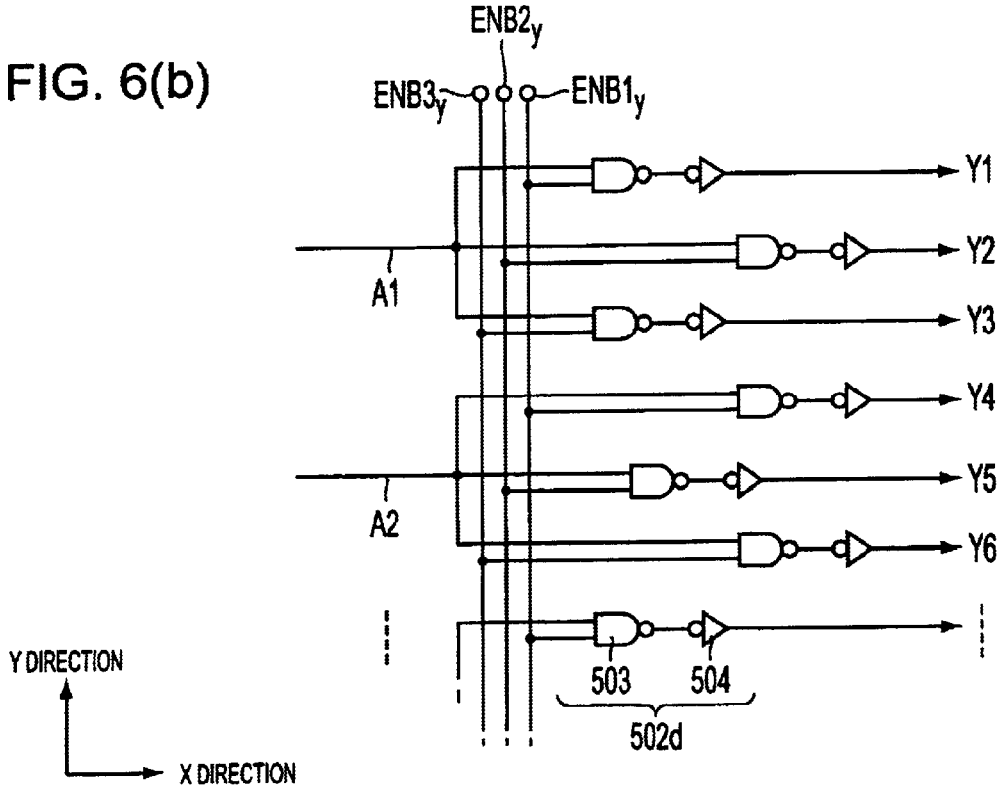

In the example illustrated in FIG. 6(*a*), enable circuits 502*c* are arranged while being sequentially shifted from each other with a fixed interval in the X direction. More specifically, the j-th enable circuit 502*c* numbered from the uppermost enable circuit 502*c* is placed at the leftmost position as viewed from FIG. 6(*a*) if the remainder obtained by dividing j by three is one. The j-th enable circuit 502*c* is located at the rightmost position as viewed from FIG. 6(*a*) if the remainder obtained by dividing j by three is zero. The j-th enable circuit 502*c* is placed between the leftmost position and the rightmost position as viewed from FIG. 6(*a*) if the remainder obtained by dividing j by three is two. In this manner, since adjacent enable circuits 502*c* are arranged in the X direction while being displaced from each other, it is possible to form the NAND gate 503 and the inverter 504 of each enable circuit 502*c* with a greater width in the Y-direction compared to those of the enable circuits 502 aligned in the Y direction, as shown in FIG. 2. Accordingly, the circuit pitch of the enable circuit 502*c* can be further reduced, thereby making it possible to form the pitch of the scanning lines very fine.

In the example illustrated in FIG. 6(*b*), enable circuits 502*d* are arranged while being alternately shifted from each other with a fixed interval in the X direction. According to this arrangement, as in the case of the previous arrangement, the NAND gate 503 and the inverter 504 can be formed with a greater width in the Y direction compared to the arrangement of the enable circuits 502 aligned in the Y direction, as shown in FIG. 2.

In FIG. 6(*a*) or FIG. 6(*b*), a description has been given, assuming that the enable circuit 502*c* or 502*d* is formed of the NAND gate 503 and the inverter 504 connected connected in series. However, the NAND gate 503 and the inverter 504 may be, of course, substituted for by the above-described transmission gate 505 or 507.

Figure 7:
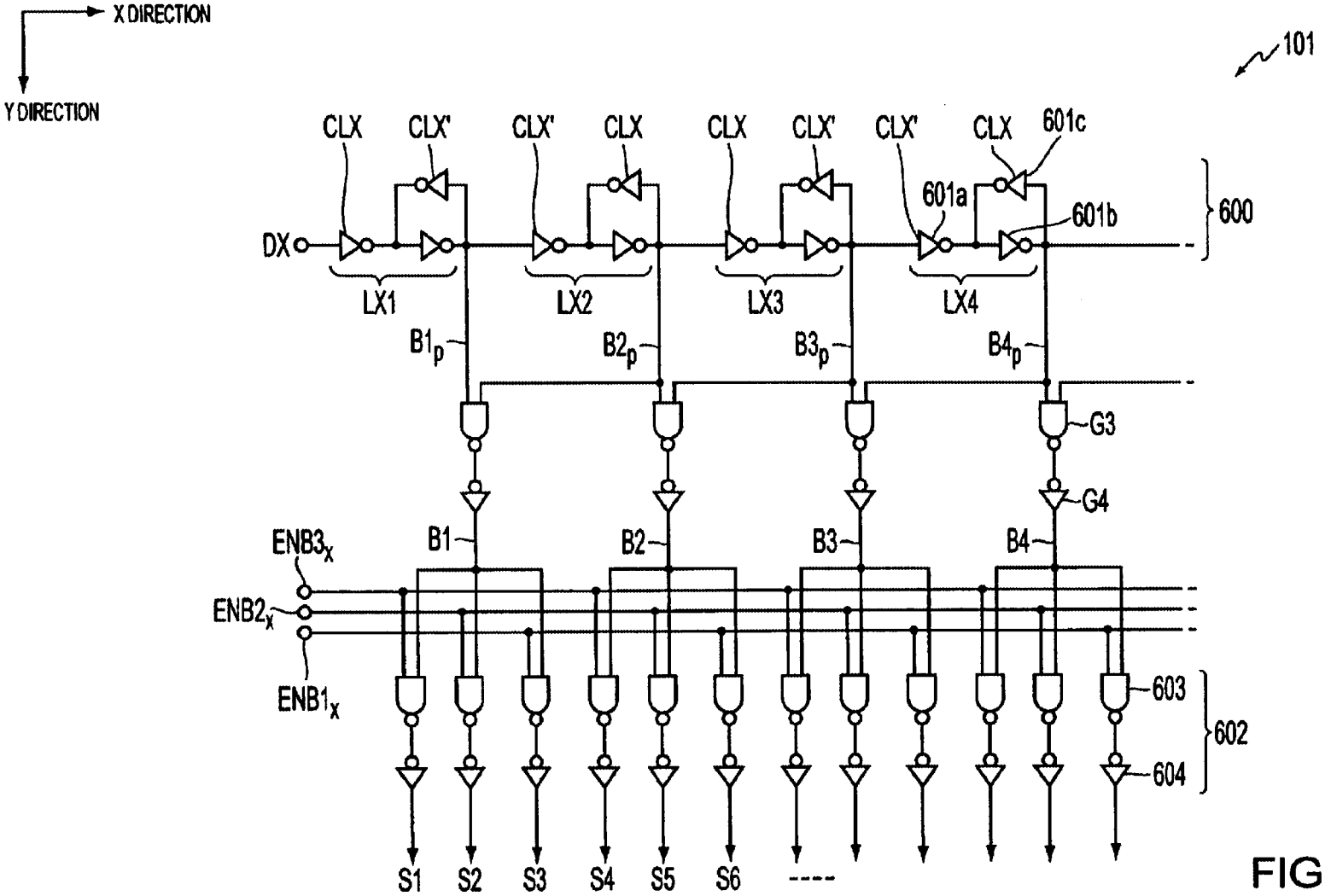
FIG. 7 is a circuit diagram illustrating the configuration of a data-line driving circuit for use in the liquid crystal device shown in FIG. 1.

The data-line driving circuit 101 for use in the liquid-crystal device shown in FIG. 1 is now described in detail. FIG. 7 is a circuit diagram illustrating the configuration of the data-line driving circuit 101. In this figure, a shift register 600 is formed by cascade-connecting unit circuits LX1, LX2 . . . in multiple stages, which are operated in response to the clock signal CLX and its inverted clock signal CLX'. The clock signal CLX is supplied from an external image signal processing circuit, and the frequency of the signal coincides with the dot frequency. The inverted clock signal CLX' is obtained by inverting the levels of the clock signal CLX, and is also supplied from the external image signal processing circuit. Further, a start pulse DX is supplied from the external image signal processing circuit to the initial-stage unit circuit LX1 at the start of a horizontal scanning period. Each of the other unit circuits receives a transfer signal passed from the previous unit circuit (from the adjacent unit circuit on the left side, as viewed from FIG. 7).

Among the respective unit circuits, the odd-numbered unit circuits LX1, LX3, . . . counted from the leftmost unit circuit read the input signal at the rising edge of the clock signal CLX and output the read signal. The even-numbered unit circuits LX2, LX4, . . . read the input signal at the rising edge of the inverted clock signal CLX' and output the read signal.

Figure 8:
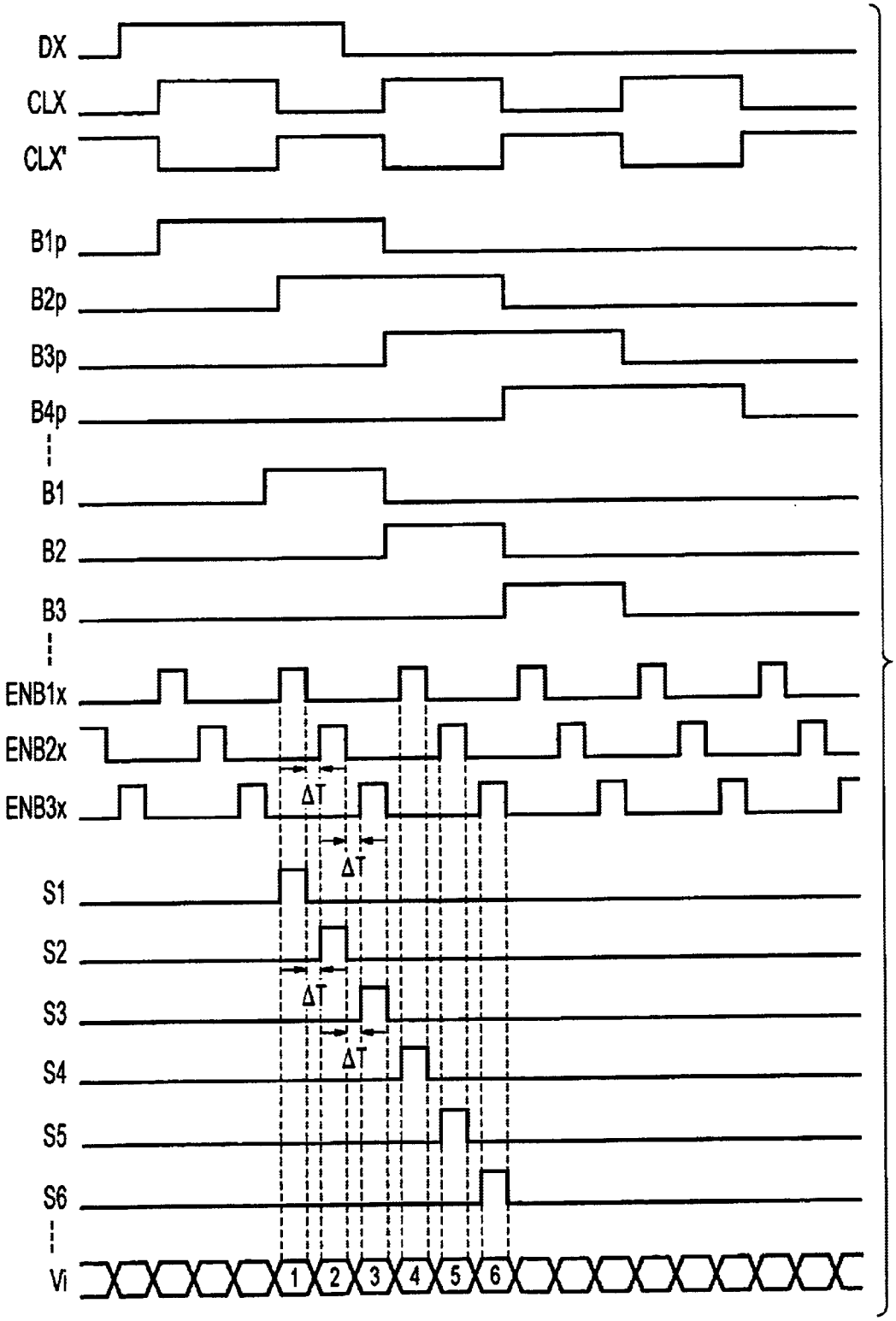
FIG. 8 is a timing chart illustrating the operation of the data-line driving circuit shown in FIG. 7.

Accordingly, output signals B1p, . . . of the respective unit circuits LX1, LX2 . . . are generated, as shown in FIG. 8. More specifically, the output signal B1p of the initial-stage unit circuit LX1 is generated by reading the start pulse DX at the rising edge of the clock signal CLX, and the output signals B2p, B3p, B4p . . . of the subsequent unit circuits LX2, LX3, LX4, . . . , respectively, are produced by sequentially delaying the output signal B1p by half a period of the clock signal CLX (the inverted clock signal CLX').

In FIG. 7, each unit circuit is formed of a clocked inverter 601 a for inverting the input signal, an inverter 601*b* for re-inverting the inverted signal, and a clocked inverter 601*c* for feeding back the re-inverted signal to the input of the inverter 601*b*. The clocked inverters 601*a* and 601*c* and the inverter 601*b* are identical to the clocked inverters 501*a* and 501*c* and the inverter 501*b*, respectively, of the scanning-line driving circuit 104 (see FIG. 2), and the clock signal CLX (and its inverted clock signal CLX') in the X direction are substituted for by the clock signal CLY (and its inverted clock signal CLY') in the Y direction.

Referring back to FIG. 7, the output terminal of each of the unit circuits LX1, LX2, . . . is provided with a NAND gate G3 and an inverter G4 connected in series to each other. Among the above elements, each NAND gate G3 outputs a NAND signal of a transfer signal from the corresponding unit circuit and a transfer signal from the subsequent-stage unit circuit (the adjacent unit circuit on the right side in FIG. 7), and each inverter G4, which is located at the output terminal of the NAND gate G3, outputs the inverted NAND signal.

As a result, transfer signals B1, B2 . . . output from the respective stages of the inverters G4 are generated, as shown in FIG. 8. That is, the transfer signals B1, B2, . . . become the H level during the period in which the transfer signal from the corresponding unit circuit and the transfer signal from the subsequent-stage unit circuit overlap. It has thus been demonstrated that the transfer signals B1, B2, . . . become the H level in turn while being exclusive to each other.

Referring back to FIG. 7 once again, each of the transfer signals B1, B2, . . . output from the respective stages of the inverters G4 is branched off into a plurality of ("three" in this embodiment) signal components. Each signal component is provided with an enable circuit 602 formed of a NAND gate 603 and an inverter 604 connected in series. The enable circuit 602 is provided for each sampling control line 306 (see FIG. 1). An output signal of the enable circuit 602 is supplied to the corresponding sampling control line 306 as a sampling control signal.

In the NAND gate 603 forming the enable circuit 602, a branched transfer signal component is supplied to one terminal of the NAND gate 603, and one of the enable signals ENB1x, ENB2x, and ENB3x is supplied to the other terminal. More specifically, the type of enable signals ENB1x, ENB2x, and ENB3x supplied to the other terminal of the i-th NAND gate 603 counted form the leftmost NAND gate 603 in FIG. 7 is calculated as follows. The enable signal ENB1x is supplied to the i-th NAND gate 603 if the remainder obtained by dividing i by three is one. The enable signal ENB2x is supplied if the remainder obtained by dividing i by three is two. The enable signal ENB3x is supplied if the remainder obtained by dividing i by three is zero.

The enable signals ENB1x, ENB2x, and ENB3x are supplied from, for example, an external image signal processing circuit, and have corresponding waveforms illustrated in FIG. 8. That is, each of the enable signals ENB1x, ENB2x, and ENB3x has a frequency two times as high as the clock signal CLX (inverted clock signal CLX'). The pulse widths of the enable signals ENB1x, ENB2x, and ENB3x are shorter than about one third of that of the clock signal CLX (inverted clock signal CLX'), and the pulse-width cycles of the corresponding enable signals are sequentially shifted from each other with a time interval ΔT.

Accordingly, sampling control signals S1, S2 . . . output from the corresponding enable circuits 602 are indicated, as illustrated in FIG. 8. More specifically, the transfer signal B1 is first sequentially divided into three components in the time domain in accordance with the enable signals ENB1x, ENB2x, and ENB3x so as to generate the sampling control signals. S1, S2, and S3, respectively, with a time interval ΔT. Likewise, the transfer signal B2 is then sequentially divided into three components in the time domain in accordance with the enable signals ENB1x, ENB2x, and ENB3x so as to generate the sampling control signals S4, S5, and S6, respectively, with a time interval ΔT. Thereafter, a dividing operation similar to that described above is repeated.

Consequently, during one horizontal scanning period, the sampling control signals S1, S2, S3, . . . are output in turn while being exclusive from each other, so that the sampling switches 302 are alternately turned on one-by-one from the leftmost sampling switch 302 in FIG. 1. As a result, the image signal Vi applied to the image signal line 400 is sequentially sampled onto the data lines 35 and are alternately written via the TFTs 30 connected to the scanning lines 31 selected during the horizontal scanning period.

The data-line driving circuit 101 constructed as described above generates sampling control signals by sequentially dividing each of the transfer signals B1, B2, B3, . . . output from the unit circuits of the shift register 600 into three components in the time domain. Accordingly, the number of stages of unit circuits is only one-third the total number of data lines 35, which is the reciprocal of the number of divided components of each transfer signal. Thus, the unit circuits, which form the shift register 600, can be formed at a pitch three times as wide as the pitch of the data lines 35 in the X direction, as well as in the Y direction. On the other hand, the enable circuit 602 is required for each data line 35. However, because of a reason similar to that given for the Y-direction enable circuit 502, it is easy to form the enable circuit 602 with a narrow pitch.

Additionally, the operating frequency of the shift register 600 is reduced to one third, which is the reciprocal of the number of divided components of each transfer signal of the enable circuits 602. Accordingly, it is not demanded that the clocked inverters 601*a* and 601*c*, and the inverter 601*b* of the shift register 600 exhibit very fast response characteristics, which is more distinctly observed compared to the Y-direction shift register 500. This further relaxes the specifications of the shift register 600, such as the circuit precision, the circuit scale, the wiring resistance, the time constant, the capacitance, the delay time, and the like.

The reason for providing a pulse interval between the X-direction enable signals ENB1x, ENB2x, and ENB3x by a time interval ΔT in contrast to the Y-direction enable signals ENB1y, ENB2y, and ENB3y (see FIG. 3) is as follows. The frequency of the X-direction clock signal CLX (inverted clock signal CLX') is much higher than that of the Y-direction clock signal CLY (inverted clock signal CLY'). Accordingly, among the sampling control signals S1, S2, and S3, slight overlapping of the period in which one of the control signals becomes the H level and that in which the adjacent signal becomes the H level due to a delay for the operation causes crosstalk or ghost. In order to avoid such a situation in advance, a time interval ΔT is provided between the pulses of the enable signals ENB1x, ENB2x, and ENB3x.

The other factors concerning the X-direction enable circuit 602 are similar to those of the Y-direction enable circuit 502. That is, the X-direction enable circuit may be formed by any one of the transmission gate or either a P-channel or N-channel TFT shown in FIGS. 5(*a*) through 5(*c*). Additionally, the enable circuits 602 may be arranged while being sequentially shifted from each other with a fixed interval in the Y direction, or may be arranged while being alternately displaced from each other with a fixed interval in the Y direction.

As described above, according to the liquid crystal device of the first embodiment, both scanning-line pitch and data-line pitch can be formed smaller than the smallest possible pitch of the unit circuits forming the corresponding shift registers. As a result, the pixel pitch can be made very fine, thereby greatly contributing to a high-definition display.

Figure 9:
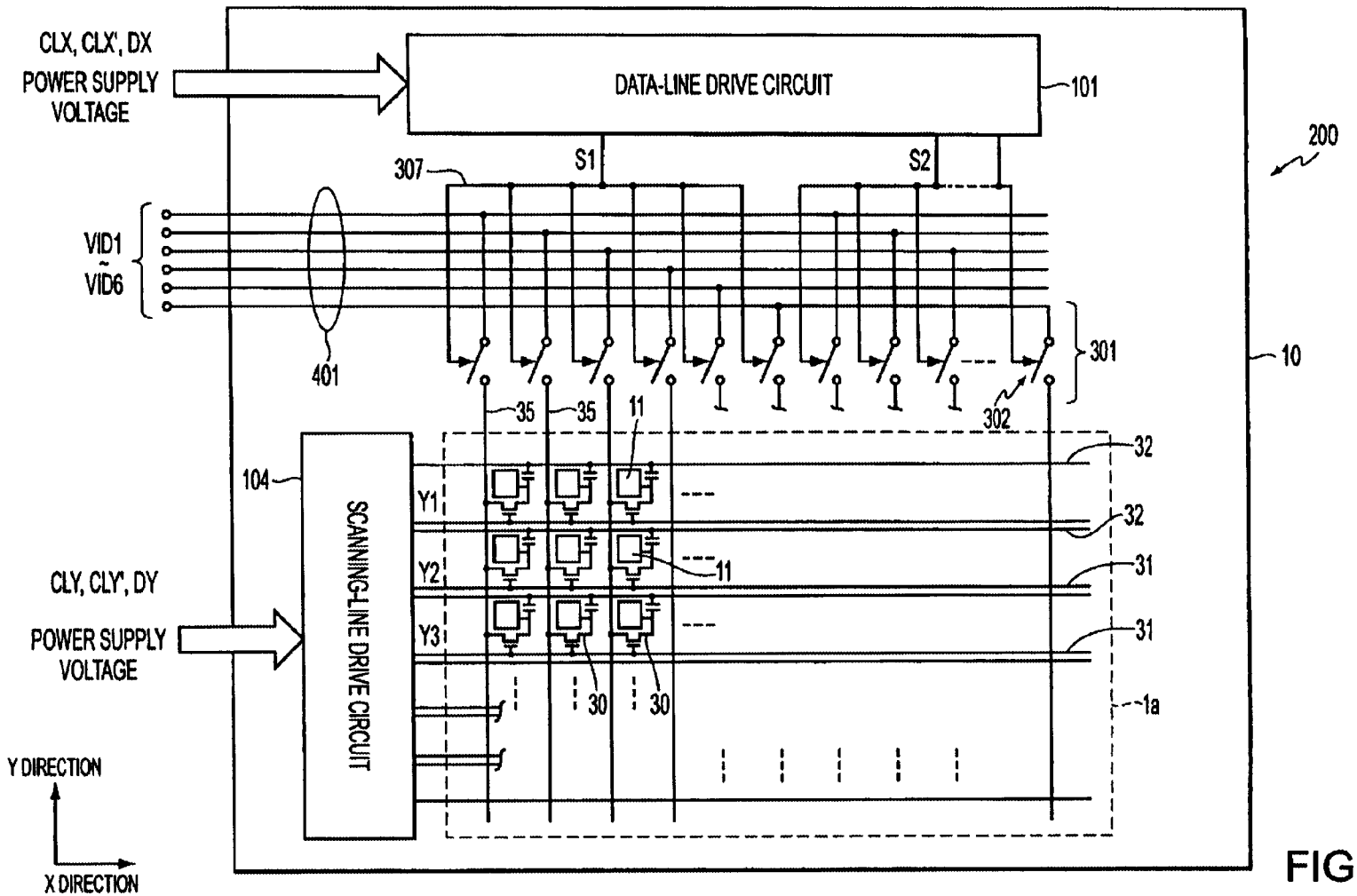
FIG. 9 is a block diagram illustrating the overall configuration of a liquid crystal device according to a second embodiment of the present invention.
Figure 10:
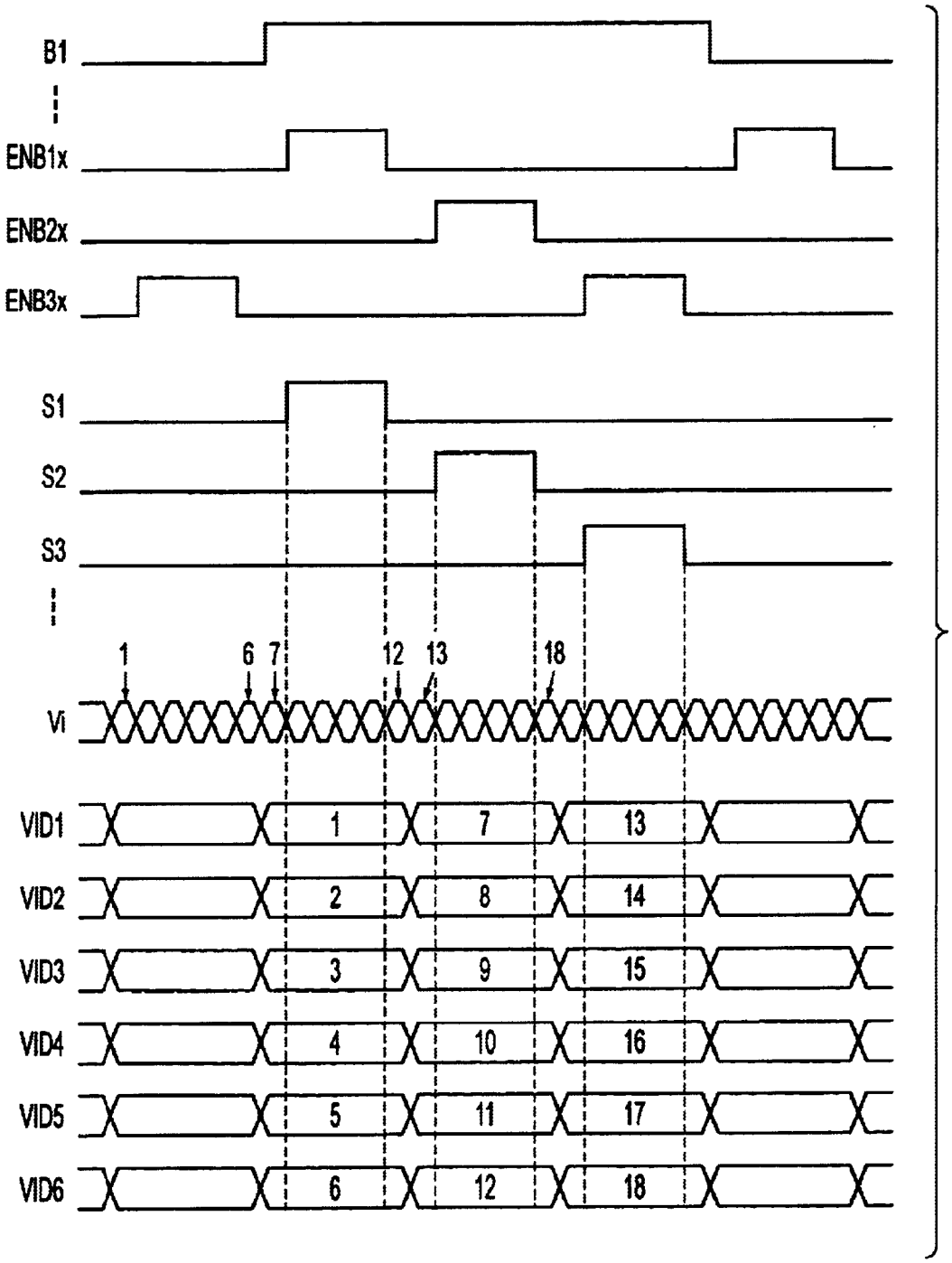
FIG. 10 is a timing chart illustrating the operation of the data-line driving circuit for use in the liquid crystal device shown in FIG. 9.

A description is now given of a liquid crystal device according to a second embodiment of the present invention. FIG. 9 is an overall block diagram illustrating the configuration of the liquid crystal device. The liquid crystal device shown in FIG. 9 differs from the liquid crystal device of the first embodiment (see FIG. 1) in the following points. Serial-parallel converted image signals are supplied via a plurality of ("six" in this embodiment) image signal lines 401, and accordingly, each sampling control signal is simultaneously supplied to a plurality of ("six" in this embodiment) sampling switches 302. The other factors concerning the liquid crystal device of the second embodiment are similar to those of the first embodiment. More specifically, the individual image signals VID1 through VID6 are generated, as shown in FIG. 10, by expanding a single-type image signal Vi by six times in the time domain by an external image signal processing circuit, and are sequentially distributed to the six image signal lines 401. Moreover, the sampling control signal components divided in the time domain by the enable circuit 602 of the data-line driving circuit 101 are further supplied to six adjacent sampling switches 302 via six branched sampling control signal lines 307. In the second embodiment, therefore, the enable circuit 602 of the data-line driving circuit 101 is not provided for each data line 35, unlike the first embodiment, but for six data lines 35.

The operation of the liquid crystal device of the second embodiment is as follows. As in the first embodiment, sampling control signals S1, S2, S3, . . . are sequentially output in turn, as illustrated in FIG. 10, during one horizontal scanning period while being exclusive from each other. When the sampling control signal S1 becomes an H level, the first through sixth sampling switches 302 counted from the leftmost sampling switch 302 as viewed from FIG. 9, namely, six sampling switches 302, are simultaneously turned on. Thus, the image signals VID1 through VID6 are sampled onto the first through sixth data lines 35, respectively, and are sequentially written via the TFTs 30 connected to the scanning lines 31 selected during the horizontal scanning period. Then, when the sampling control signal S2 becomes an H level, the seventh through twelfth sampling switches 302, namely, six sampling switches 302, are simultaneously turned on. Accordingly, the image signals VID1 through VID6 are sampled onto the seventh through twelfth data lines 35, respectively, and are sequentially written via the TFTs 30 connected to the scanning lines 31 selected during the horizontal scanning period. Thereafter, an operation similar to that discussed above is repeated.

As stated above, according to the second embodiment, the number of stages of the unit circuits of the data-line driving circuit 101 is reduced to the reciprocal of the product of the number of divided transfer signal components based on the transfer circuit and the number of sampling switches 302 simultaneously driven by the same sampling control signal. That is, in the second embodiment, the number of divided transfer signal components is "three", as in the first embodiment, and the number of sampling switches 302, which are simultaneously driven, is "six". Thus, the number of stages of the unit circuits of the data-line driving circuit 101 is reduced to 1/18 of the total number of data lines 35. This makes it possible to significantly relax the limit of the pitch of the unit circuits of the shift registers, in particular, the X-direction shift register 600 (see FIG. 7), thereby accelerating a reduction in the pitch of the data lines 35. Additionally, in accordance with a decreased number of stages of the unit circuits, the driving frequency of, in particular, the X-direction shift register 600, can be reduced to 1/18 in this embodiment.

The second embodiment is configured in such a manner that the number of converted (expanded) image signals is "six", and that six sampling switches 302 are concurrently driven. The number of converted image signals (and the number of sampling switches 302, which are concurrently driven) are determined according to the performance of the sampling switches 302. For example, in response to a high sampling level of the sampling switches 302, the image signal Vi (which is not serial-parallel converted) may be sequentially supplied to each data line 35, as in the first embodiment. In response to a low sampling level, the image signal Vi may be serial-parallel converted into two or more types of image signals, and supplied to the corresponding number of data lines 35. The number of converted image signals is preferably an integral multiple of three in order to achieve a simplified control operation and circuit, since a color image signal is composed of signal components relating to three colors.

The other factors of the second embodiment are similar to those of the first embodiment. More specifically, the pitch of the unit circuits forming the (Y-direction) shift register 500 of the scanning-line driving circuit 104 is decreased. The X-direction or the Y-direction enable circuit may be formed by a transmission gate or either a P-channel type or N-channel type TFT. The enable circuits may be arranged by being sequentially shifted from each other with a fixed interval in the corresponding direction, or may be arranged while being alternately displaced from each other in the corresponding direction.

Figure 11:
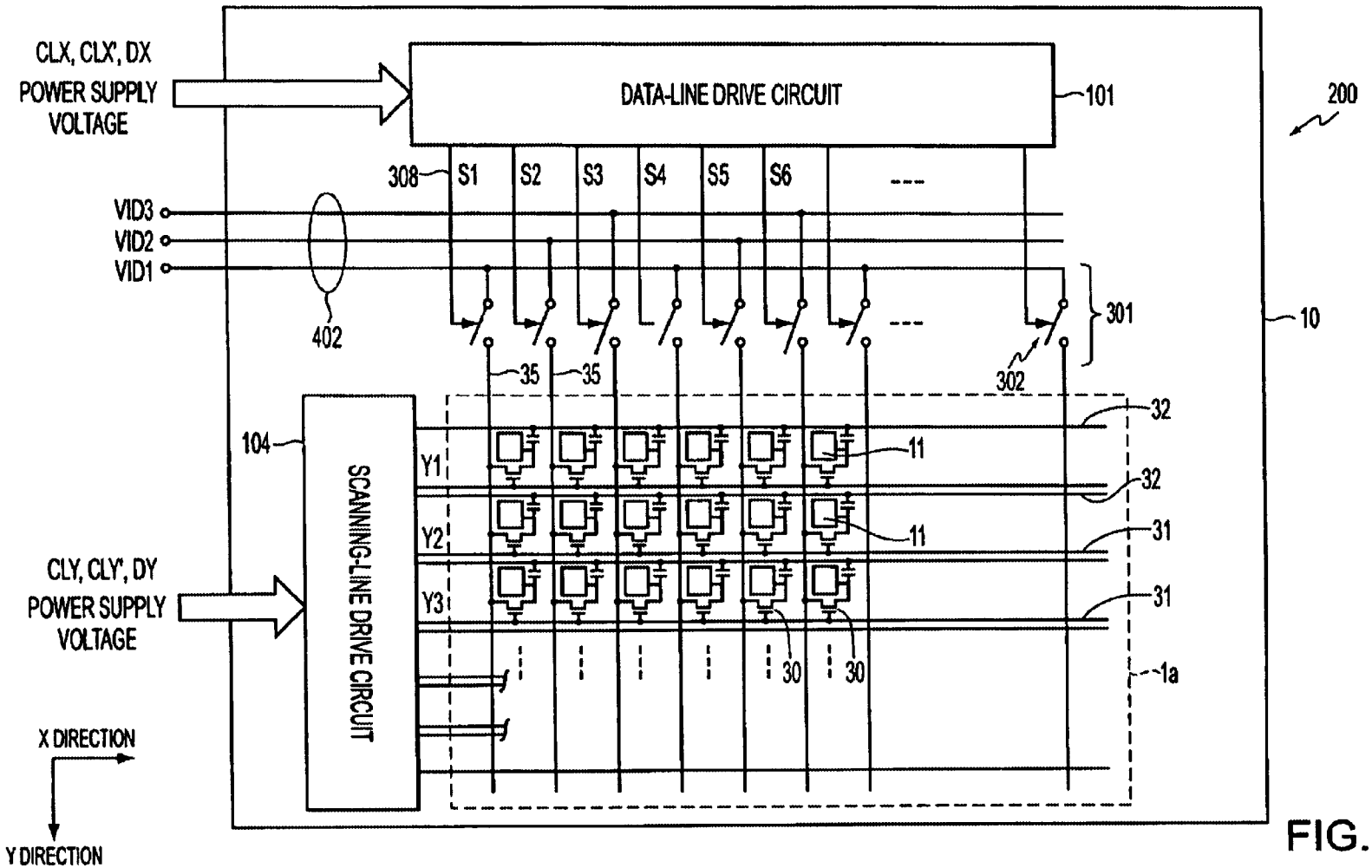
FIG. 11 is a block diagram illustrating the overall configuration of a liquid crystal device according to a third embodiment of the present invention.

A liquid crystal device according to a third embodiment of the present invention is now described. FIG. 11 is an overall block diagram illustrating the configuration of the liquid crystal device. The liquid crystal device shown in this figure is similar to that of the second embodiment (see FIG. 9) in that image signals VID1 through VID3 are supplied via a plurality of image signal lines 402, but is different in that a sampling control signal is supplied to each sampling switch 302. Accordingly, each of the sampling control signal lines 308 is not branched off into a plurality of components, unlike the second embodiment, but is connected only to a corresponding sampling switch 302. In the third embodiment, therefore, an enable circuit 602 of the data-line driving circuit 101 is provided for each data line 35, as in the first embodiment. The other factors of the third embodiment are similar to those of the liquid crystal devices of the first and second embodiments.

The liquid crystal device of the third embodiment performs a display operation in either of the following two operation modes. That is, the liquid crystal device performs a display operation in a first operation mode in which an image signal Vi is supplied to three image signal lines 402 without being serial-parallel converted (sequential driving), or in a second operation mode in which the image signal Vi is serial-parallel converted into three components, which are then sequentially supplied to the three image signal lines (simultaneous-multiple driving). The operation of the scanning-line driving circuit 104 is similar to that of the first or second embodiments regardless of whether the first mode or the second mode is employed. The operation of the data-line driving circuit 101 of this embodiment is similar to that of the first or second embodiments in that the transfer signals B1, B2, . . . are output while being sequentially shifted from each other by half a period of the X-direction clock CLX (inverted clock signal CLX'). After this point, the operation of the data-line driving circuit 101 becomes different from that of the first or second embodiment, which is explained below.

Figure 12:
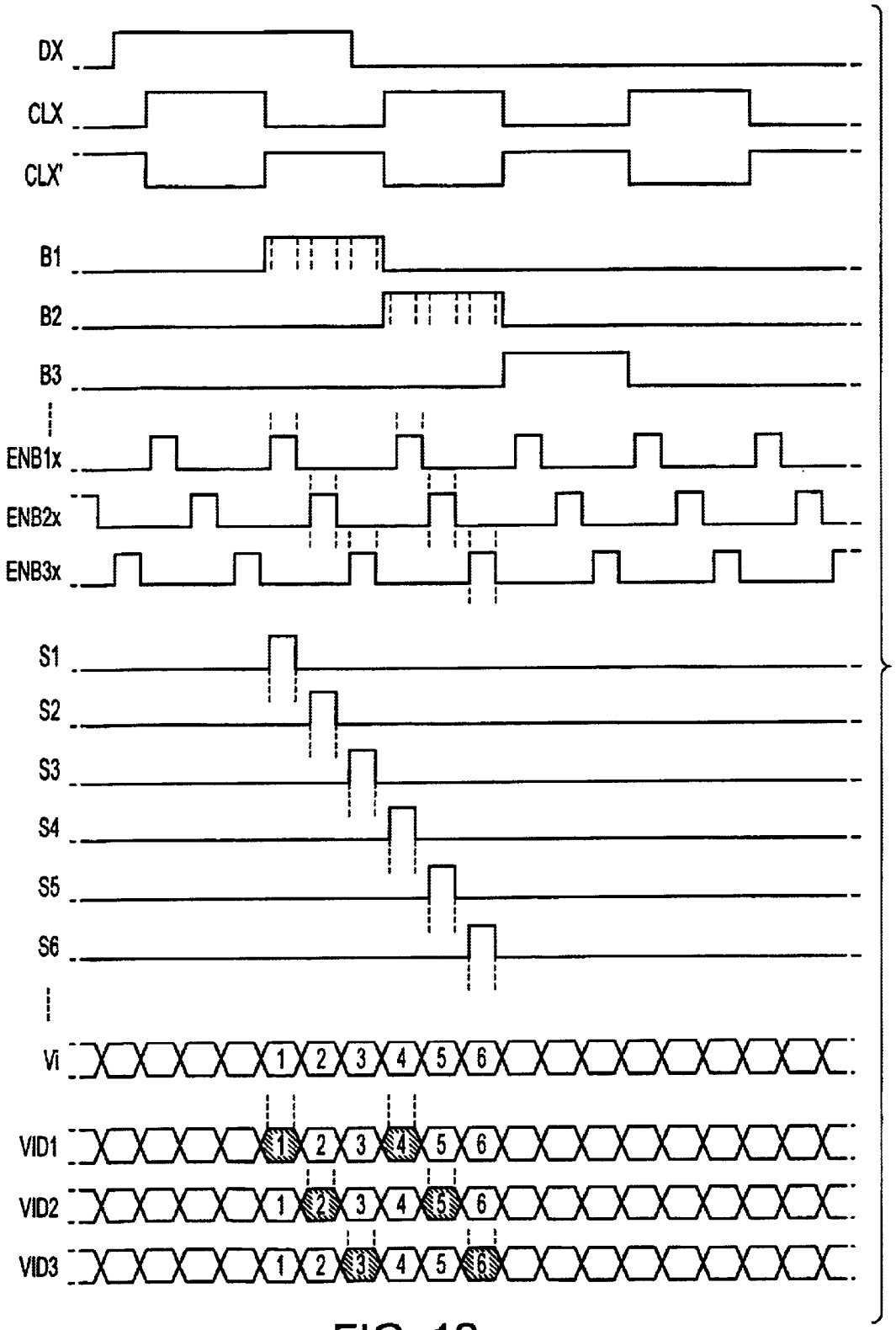
FIG. 12 is a timing chart illustrating the operation of the data-line driving circuit of the liquid crystal device shown in FIG. 11 when being operated in the first operation mode.

A description is first given of the display operation performed in accordance with the first operation mode. In the first operation mode, the following enable signals END1x, ENB2x, and ENB3x are supplied to the corresponding enable circuits 602 (see FIG. 7). More specifically, the enable signals ENB1x, ENB2x, and ENB3x have a frequency twice as high as the clock signal CLX (inverted clock signal CLX'), as illustrated in FIG. 12. The pulse widths of the enable signals ENB1x, ENB2x, and ENB3x are shorter than about one third of that of the clock signal CLX (inverted clock signal CLX'), and the pulse-width cycles of the corresponding enable signals are sequentially shifted from each other with a time interval ΔT.

Consequently, as in the first embodiment, the transfer signal B1 output from the initial-stage inverter G4 is sequentially divided into three components in the time domain in accordance with the enable signals ENB1x, ENB2x, and ENB3x so as to generate sampling control signals S1, S2, S3, . . . , respectively, with a time interval ΔT. Similarly, the transfer signal B2 is then sequentially divided into three components in the time domain in accordance with the enable signals ENB1x, ENB2x, and ENB3x so as to produce sampling control signals S4, S5, and S6, respectively. A dividing operation similar to that described above is repeated.

Hence, during one horizontal scanning period, the sampling control signals S1, S2, S3, . . . are output in turn while being exclusive to each other, so that the sampling switches 302 are turned on one-by-one from the leftmost sampling switch 302 as viewed from FIG. 11. As a result, the image signals VID1 through VED3 applied to the image signal lines 402, namely, the image signal Vi itself, are sequentially sampled onto the corresponding data lines 35 and are written via the TFTs 30 connected to the scanning lines 31 selected in the horizontal scanning period.

As described above, in the liquid crystal device according to the third embodiment, when being operated in the first mode, the image signal is sampled onto each of the data lines 35, thereby sequentially driving the corresponding pixel portions.

Figure 13:
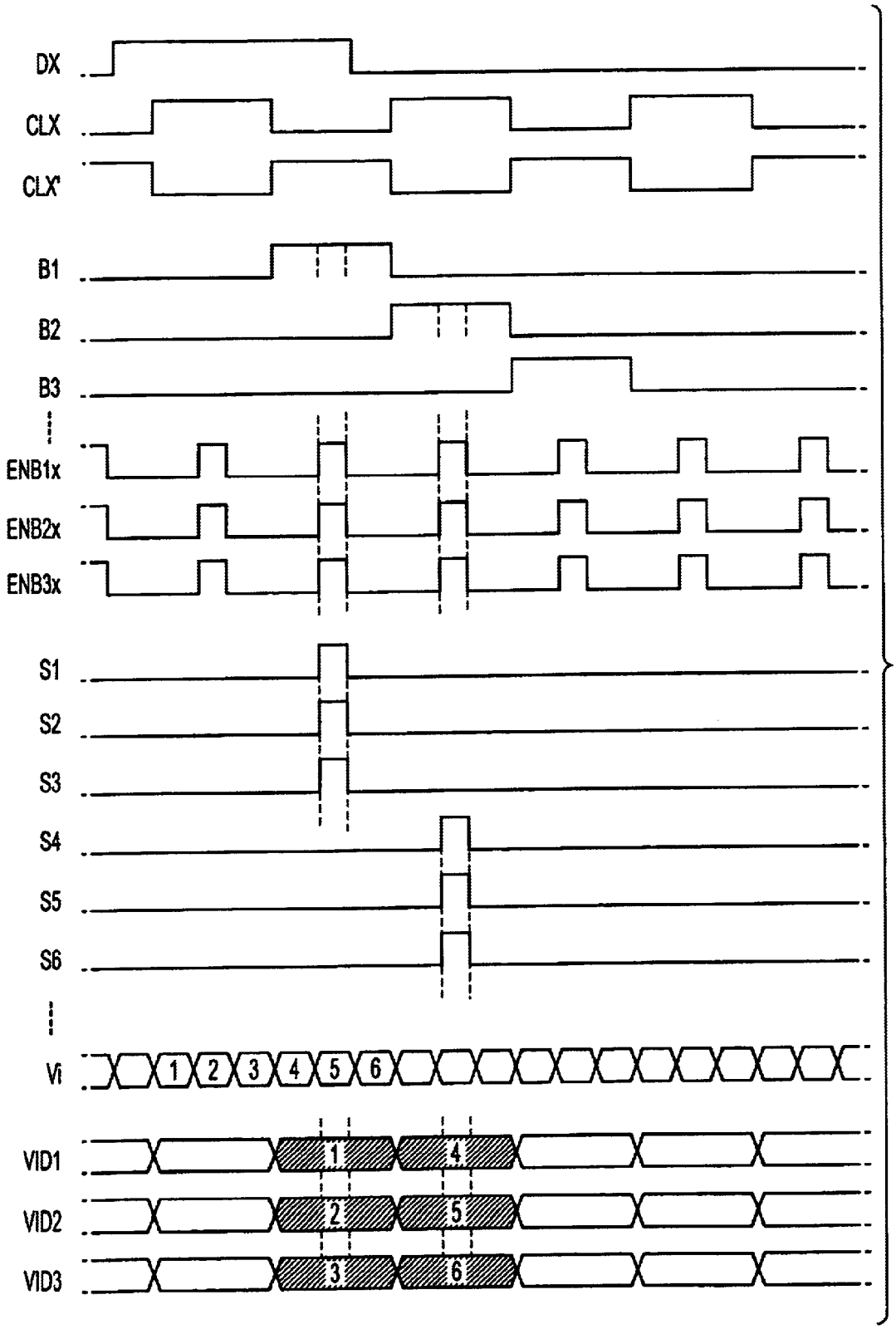
FIG. 13 is a timing chart illustrating the operation of the data-line driving circuit of the liquid crystal device shown in FIG. 11 when being operated in the second operation mode.

The display operation performed in accordance with the second operation mode is as follows. In the second operation mode, the following enable signals ENB1x, ENB2x, and ENB3x are supplied to the corresponding enable circuit 602 (see FIG. 7). More specifically, as illustrated in FIG. 13, the enable signals ENB1x, ENB2x, and ENB3x have a frequency twice as high as the clock signal CLX (inverted clock signal CLX'). The pulse widths of the enable signals ENB1x, ENB2x, and ENB3x are shorter than that of the clock signal CLX (inverted clock signal CLX'), and the pulse-width cycles of the enable signals ENB1x, ENB2x, and ENB3x are in phase.

Thus, since the transfer signal B1 output from the initial-stage inverter G4 is simultaneously distributed in accordance with the enable signals ENB1x, ENB2x, and ENB3x, the resulting sampling control signals S1, S2, and S3 become identical. Accordingly, the first through third sampling switches 302 counted from the leftmost sampling switch 302 in FIG. 11 are simultaneously turned on. Then, the serial-parallel converted image signals VID1 through VID3 are concurrently sampled onto the first through third data lines 35 numbered from the leftmost data line 35, and are written via the TFTs 30 connected to the scanning lines 31 selected during the horizontal scanning period.

Likewise, since the transfer signal B2 is simultaneously distributed in accordance with the enable signals ENB1x, ENB2x, and ENB3x, the resulting sampling control signals S4, S5, and S6 become identical. Accordingly, the fourth through sixth sampling switches 302 counted from the leftmost sampling switch 302 in FIG. 11 are turned on at the same time. Then, the serial-parallel converted image signals VID1 through VID3 are simultaneously sampled onto the fourth through sixth data lines 35 numbered from the leftmost data line 35, and are written via the TFTs 30 connected to the scanning lines 31 selected during the horizontal scanning period. Thereafter, an operation similar to that described above is repeated in units of three sampling switches 302 (three data lines 35).

As discussed above, in the liquid crystal device according to the third embodiment, when being operated in the second operation mode, serial-parallel converted image signals are sampled onto three data lines 35, and the corresponding three pixel portions are simultaneously driven. Thus, the liquid crystal device of the third embodiment can be driven by any one of a sequential driving mode and a simultaneous-multiple driving mode.

The other factors of the third embodiment are similar to those of the first and second embodiments. More specifically, the pitch of the unit circuits forming the (Y-direction) shift register 500 of the scanning-line driving circuit 104 is decreased. Additionally, the X-direction or Y-direction enable circuit may be formed by a transmission gate or either a P-channel or N-channel TFT. The X-direction or Y-direction enable circuits may be arranged while being sequentially shifted from each other in the corresponding direction with a fixed interval, or may be arranged in the corresponding direction while being alternately displaced from each other.

Figure 14:
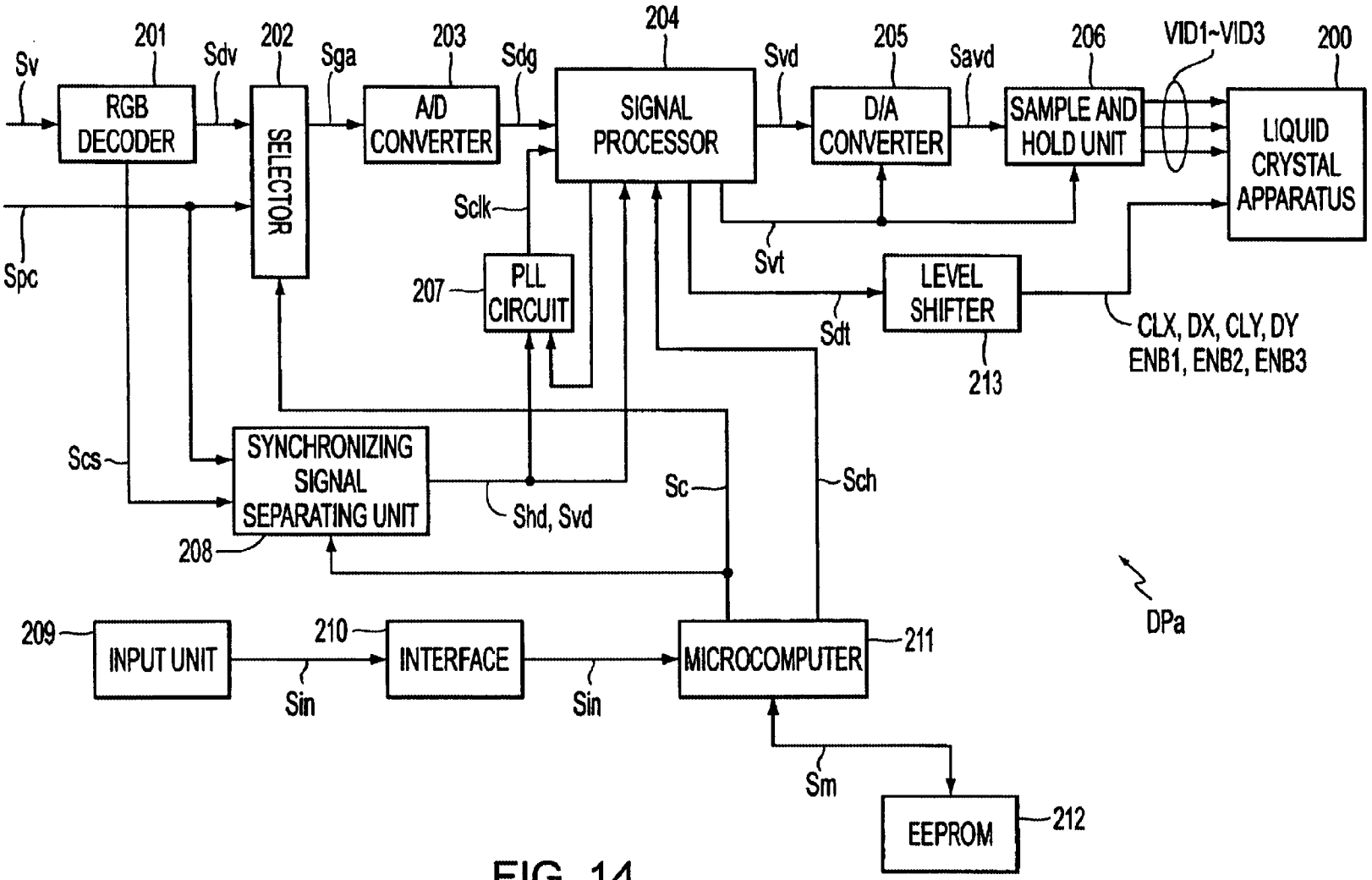
FIG. 14 is a block diagram illustrating an example of the configuration of an image signal processing circuit together with the liquid crystal device shown in FIG. 11.

A description is now given of the configuration of the image signal processing circuit that supplies to the liquid crystal device of the third embodiment, not only the image signals VID1 through VID3, but also various timing signals, such as the enable signals ENB1x, ENB2x, and ENB3x, in accordance with the first or second operation mode. FIG. 14 is a block diagram illustrating the configuration of an image signal processing circuit DPa together with the liquid crystal device 200.

In this figure, an RGB decoder 201 extracts a red signal, a green signal, and a blue signal corresponding to what is called three optical primary colors from a video signal Sv input from an external source, for example, a video reproduction device, and supplies the extracted signals as a primary color signal Sdv to one input terminal of a selector 202. The RGB decoder 201 also extracts a composite synchronizing signal Scs from the video signal Sv and supplies it to one input terminal of a synchronizing-signal separating unit 208. The above-described video signal Sv is a video-type signal according to, for example, NTSC, PAL, SECAM, or the like.

Meanwhile, an RGB signal Spc is an image signal input from an external source, for example, a computer. The RGB signal Spc is supplied to the other input terminal of the selector 202 and also to the other input terminal of the synchronizing-signal separating unit 208. The RGB signal is what is called a data-type signal.

The selector 202 then selects one of the above-mentioned primary color signal Sdv and the RGB signal Spc based on a selection signal Sc from a microcomputer 211, and outputs it to an A/D converter 203 as a selected image signal Sga. Subsequently, the A/D converter 203 digitizes the selected image signal Sga and supplies it to a signal processor 204 as a digital image signal Sdg.

In the image signal processing circuit DPa, the following two patterns are considered. In one pattern, when both primary color signal Sdv and RGB signal Spc are input, the selector 202 selects one of the signals. In the other pattern, when only one of the primary color signal Sdv and the RGB signal Spc is input, the selector 202 selects that input signal and outputs it.

The synchronizing-signal separating unit 208 extracts a synchronizing signal from one of the composite synchronizing signal Scs or the RGB signal Spc based on the selection signal Sc so as to generate a horizontal synchronizing signal Shd and a vertical synchronizing signal Svd, which are then supplied to a PLL circuit 207 and the signal processor 204. Subsequently, the PLL (Phase Locked Loop) circuit 207 generates, based on the input horizontal synchronizing signal Shd, a clock signal Sclk used for signal processing in the signal processor 204 and supplies it to the signal processor 204.

An input unit 209 has an operating portion (not shown) operated by a user and outputs a signal Sin indicating the setting. The input unit 209 of this embodiment generates the signal Sin representing, in particular, whether the first operation mode (sequential driving) or the second operation mode (simultaneous-multiple driving) is employed in the liquid crystal device 200, and supplies the signal Sin to an interface 210. Generally, when an image produced by the video signal Sv is displayed, the user operates the input unit 209 to set the first operation mode in order to retain the uniformity of the image. On the other hand, when an image generated by the RGB signal Spc is displayed, the user operates the input unit 209 to set the second operation mode in order to maintain the rapidity of the image.

The interface 210 then converts the signal Sin output from the input unit 209 into a signal which can be suitably processed by the microcomputer 211. If the signal Sin indicates the setting of the first operation mode, the microcomputer 211 outputs the selection signal Sc instructing a selection of the video signal Sv and a control signal Sch instructing that a control operation should be performed in the first operation mode. If, however, the signal Sin represents the setting of the second operation mode, the microcomputer 211 outputs the selection signal Sc instructing a selection of the RGB signal Spc and the control signal Sch instructing that a control operation should be performed in the second operation mode. In this case, the microcomputer 211 exchanges necessary information Sm with an EEPROM (Electrically Erasable and Programmable Read Only Memory) 212.

Then, the signal processor 204 executes the following processing. First, the signal processor 204 performs signal processing, such as gamma correction, on the input digital image signal Sdg and outputs it as an image signal Svd. Secondly, the signal processor 204 generates a timing signal Svt which is required in the operation mode represented by the control signal Sch, based on the horizontal synchronizing signal Shd, the vertical synchronizing signal Svd, and the clock signal Sclk, and supplies the timing signal Svt to a D/A converter 205 and to a sample-and-hold unit 206. Thirdly, the signal processor 204 produces a timing signal Sdt, which is necessary for a driving operation performed by the liquid crystal device 200 and required in the operation mode indicated by the control signal Sch, based on the horizontal synchronizing signal Shd, the vertical synchronizing signal Svd, and the clock signal Sclk. The timing signal Sdt is then supplied to a level shifter 213. The timing signal Sdt generically represents the X-direction clock signal CLX (and its inverted clock signal CLX'), the Y-direction clock signal CLY (and its inverted clock signal CLY'), the X-direction start pulse DX, the Y-direction start pulse DY, the X-direction enable signals ENB1x, ENB2x, and ENB3x, and the Y-direction enable signals ENB1y, ENB2y, and ENB3y, all of which are signals having a short pulse width obtained by the logical AND. The enable signals ENB1x, ENB2x, and ENB3x in the first operation mode are indicated by corresponding waveforms, as shown in FIG. 12, while the enable signals ENB1x, ENB2x, and ENB3x in the second mode are indicated by corresponding waveforms, as shown in FIG. 13. The enable signals ENB1x, ENB2x, and ENB3x having a short pulse width obtained by the logical AND are output.

The D/A converter 205 converts the digital image signal Svd processed by the signal processor 204 into an analog signal Savd based on the timing signal Svt. The sample-and-hold unit 206 samples and holds the analog image signal Savd based on the timing signal Svt. In particular, when the first operation mode is employed, the sample-and-hold unit 206 distributes the analog signal Savd into the same image signals VID1 through VID3. When the second operation mode is employed, the sample-and-hold unit 206 converts the analog signal Savd into three types of image signals VID1 through VID3. The resulting image signals VID1 through VID3 are supplied to the liquid crystal device 200. The level shifter 213 converts the individual signals contained in the timing signal Sdt into signals having a long pulse width obtained by the logical AND, and supplies the converted signals into the liquid crystal device 200.

In the image signal processing circuit DPa constructed as described above, when the first operation mode is set in the input unit 209, the selection signal Sc instructing a selection of the video signal Sv is output from the microcomputer 211. Accordingly, the video signal Sv is selected in the selector 202, and is supplied to the signal processor 204 after being converted into a digital signal in the A/D converter 203. The synchronizing-signal separating unit 208 selects the composite synchronizing signal Scs extracted from the video signal Sv and further extracts a synchronizing signal contained in the composite synchronizing signal Scs. Moreover, the control signal Sch instructing that a control operation should be performed in the first operation mode is output from the microcomputer 211. This enables the signal processor 204 to output the enable signals ENB1x, ENB2x, and ENB3x which are sequentially shifted from each other without overlapping the pulse widths during half a period of the clock signal CLX (and its inverted clock signal CLX'). The signal processor 204 further outputs the timing control signal Svt for the first operation mode, so that the analog image signal Savd can be supplied from the sample-and-hold unit 206 as the same image signals VID1 through VID3 without being serial-parallel converted.

Conversely, if the second operation mode is set in the input unit 209, the selection signal Sc instructing a selection of the RGB signal Spc is output from the microcomputer 211. Accordingly, the RGB signal Spc is selected in the selector 202, and is supplied to the signal processor 204 after being converted into a digital signal in the A/D converter 203. Moreover, the synchronizing-signal separating unit 208 selects the RGB signal Spc and extracts a synchronizing signal included in the RGB signal Spc. Further, the control signal Sch instructing that a control operation should be performed in the second operation mode is output from the microcomputer 211. This enables the signal processor 204 to output the enable signals ENB1x, ENB2x, and ENB3x in phase during half a period of the clock signal CLX (and its inverted clock signal CLX'). The signal processor 204 also outputs the timing control signal Svt for the second operation mode. Thus, the analog image signal Savd is serial-parallel converted in the sample-and-hold unit 206, and more specifically, the analog image signal Savd is expanded by three times in the time domain and is also distributed onto three image signal lines so as to be supplied as the image signals VID1 through VID3.

Therefore, in the liquid crystal device 200, if the input image signal is the video signal Sv, the sequential driving operation is performed. In contrast, if the input image signal is the RGB signal Spc, the simultaneous-multiple driving operation is performed. Generally, sequential driving is suitable for video-type signals, such as the video signal Sv, since a resulting image contains more motion. Conversely, simultaneous-multiple driving is appropriate for data-type signals, such as the RGB signal Spc, since a resulting image includes less (or no) motion. According to the above-described image signal processing circuit DPa, sequential driving or simultaneous-multiple driving can be switched by setting the operation mode through the input unit 209. As a result, a high-quality display is achieved in the liquid crystal device 200 regardless of whether the video signal Sv or the RGB signal Sv is input.

An example of applications of the image signal processing circuit is now described. In the image signal processing circuit DPa shown in FIG. 14, the first operation mode (sequential driving) and the second operation mode (simultaneous-multiple driving) are switched according to the setting of the input unit 209 input by the user. An image signal processing circuit according to this application example detects the presence or absence of motion in an image to be displayed, and switches between the operation modes based on the detection result.

Figure 15:
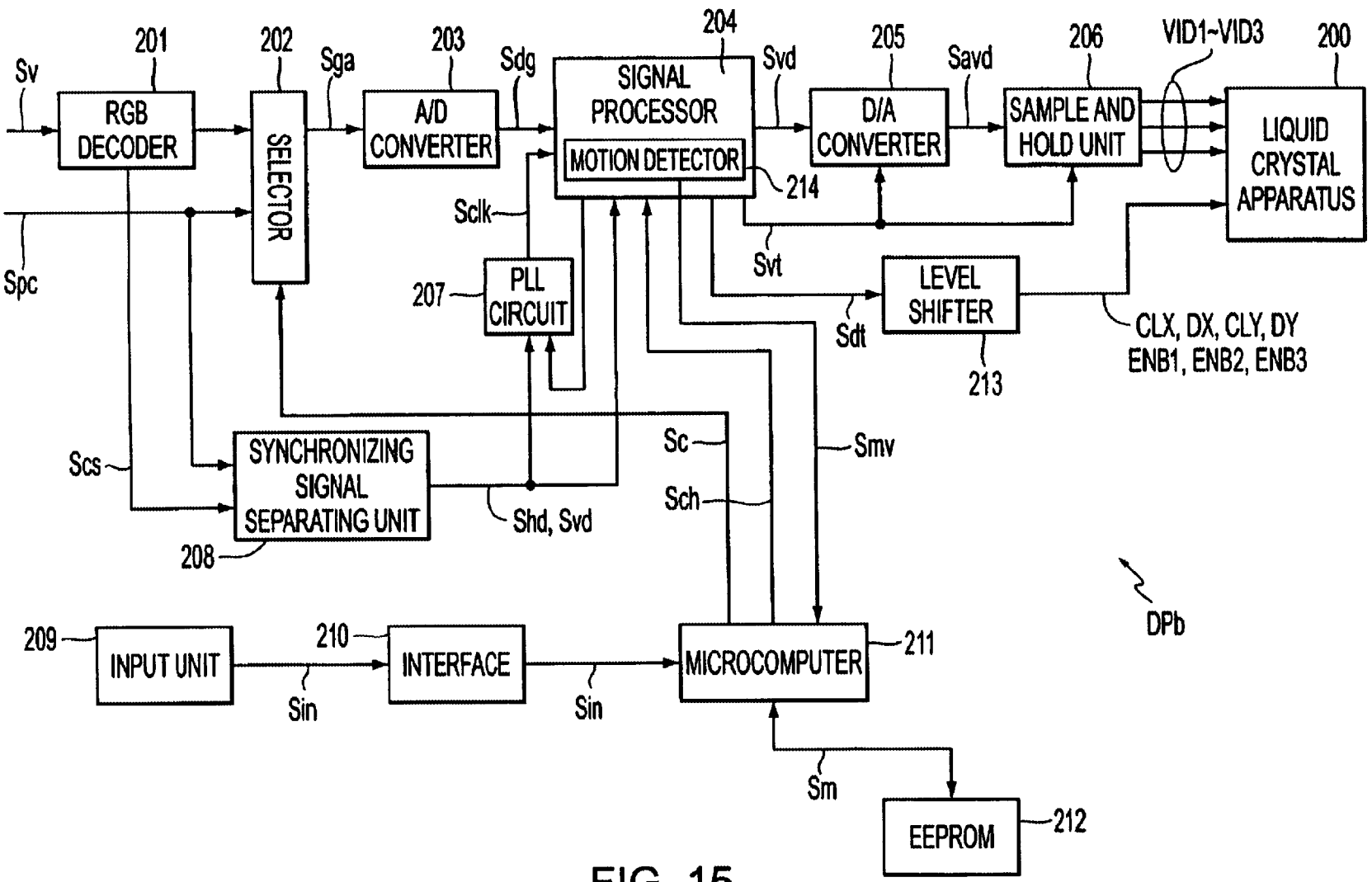
FIG. 15 is a block diagram illustrating another example of the configuration of the image signal processing circuit.

FIG. 15 is a block diagram illustrating the configuration of the image signal processing circuit of this example together with the liquid crystal device 200. An image signal processing circuit DPb illustrated in FIG. 15 differs from the image signal processing circuit DPa shown in FIG. 14 in the following three points. A motion detector 214 for detecting whether an image to be displayed includes motion is provided for the signal processor 204. A microcomputer 211*b* sets the operation mode according to a detection signal Smv output from the motion detector 214. The function of the input unit 209 is not for setting the operation mode, but merely for setting whether an image to be input as a video signal Sv or an image to be input as an RGB signal Spc is displayed. The other factors of the image signal processing circuit DPb are similar to those of the image signal processing circuit DPa shown in FIG. 14, and an explanation thereof will thus be omitted.

In this application example, if it has been set in the input unit 209 that an image to be input as the video signal Sv is displayed, the selection signal Sc instructing a selection of the video signal Sv is output from the microcomputer 211*b*. Accordingly, the video signal Sv is selected by the selector 202, and is supplied to the signal processor 204 after being converted into a digital signal by the A/D converter 203. Meanwhile, the synchronizing-signal separating unit 208 selects the composite synchronizing signal Scs extracted from the video signal Sv and further extracts a synchronizing signal contained in the composite synchronizing signal Scs.

On the other hand, if it has been set in the input unit 209 that an image to be input as the RGB signal Spc is displayed, the selection signal Sc instructing a selection of the RGB signal Spc is output from the microcomputer 211*b*. Accordingly, the RGB signal Spc is selected by the selector 202, and is supplied to the signal processor 204 after being converted into a digital signal by the A/D converter 203. The synchronizing-signal separating unit 208 selects the RGB signal Spc and further extracts a synchronizing signal contained in the RGB signal Spc.

As a consequence, the digital image signal Sdg is supplied to the signal processor 204 regardless of whether the video signal Sv or the RGB signal Spc is input. The motion detector 214 provided for the signal processor 204 detects the presence or absence of motion in the digital image signal Sdg, and generates a detection signal Smv and outputs it to the microcomputer 211*b*.

The microcomputer 211*b* determines the operation mode in the following manner based on the motion detection signal Smv. More specifically, if motion is detected in the image represented by the digital image signal Sdg during a predetermined period (for example, one second), the microcomputer 211*b* generates the control signal Sch indicating the setting of the first operation mode (sequential driving). If, however, no motion is detected during the predetermined period, the microcomputer 211*b* produces the control signal Sch indicating the setting of the second operation mode (simultaneous-multiple driving). The control signal Sch is then supplied to the signal processor 204.

Thereafter, an operation similar to that discussed above is performed by the signal processor 204 in accordance with the control signal Sch. More specifically, in response to the control signal Sch instructing that a control operation should be performed in the first operation mode, the enable signals ENB1x, ENB2x, and ENB3x are output from the signal processor 204 while being sequentially shifted from each other without overlapping the pulse widths during half a period of the clock signal CLX (and its inverted clock signal CLX'), and also, the timing control signal Svt for the first operation mode is output from the signal processor 204. Thus, the sample-and-hold unit 206 supplies the analog image signal Savd as the same image signals VID1 through VID3 without serial-parallel converting it.

Conversely, in response to the control signal Sch instructing that a control operation should be performed in the second operation mode, the enable signals ENB1x, ENB2x, and ENB3x are output from the signal processor 204 in phase during half a period of the clock signal CLX (and its inverted clock signal CLX'), and the timing control signal Svt for the second operation mode is output from the signal processor 204. Then, the analog image signal Savd is serial-parallel converted in the sample-and-hold unit 206 and is supplied as the image signals VID1 through VID3.

As described above, according to the image signal processing circuit DPb of this application example, sequential driving is conducted if there is any motion (or rapid motion) contained in an image represented by the input video signal Sv or the RGB signal Spc, while simultaneous-multiple driving is performed if there is no motion (or less motion) in the image. Thus, by the use of the image signal processing circuit DPb, the driving mode is suitably switched regardless of whether motion is contained in an image, thereby enabling high-quality display in the liquid crystal device 200.

A liquid crystal device according to a fourth embodiment of the present invention is now described. The overall configuration of the liquid crystal device of this embodiment is similar to that of the aforementioned third embodiment (see FIG. 11). That is, in the liquid crystal device of the fourth embodiment, the image signals VID1 through VID3 are supplied via the three image signal lines 402, and a single sampling control signal is supplied to each sampling switch 302. The liquid crystal device of the fourth embodiment is also similar to that of the third embodiment in that it is driven by any one of the first operation mode (sequential driving) and the second operation mode (simultaneous-multiple driving).

Figure 16:
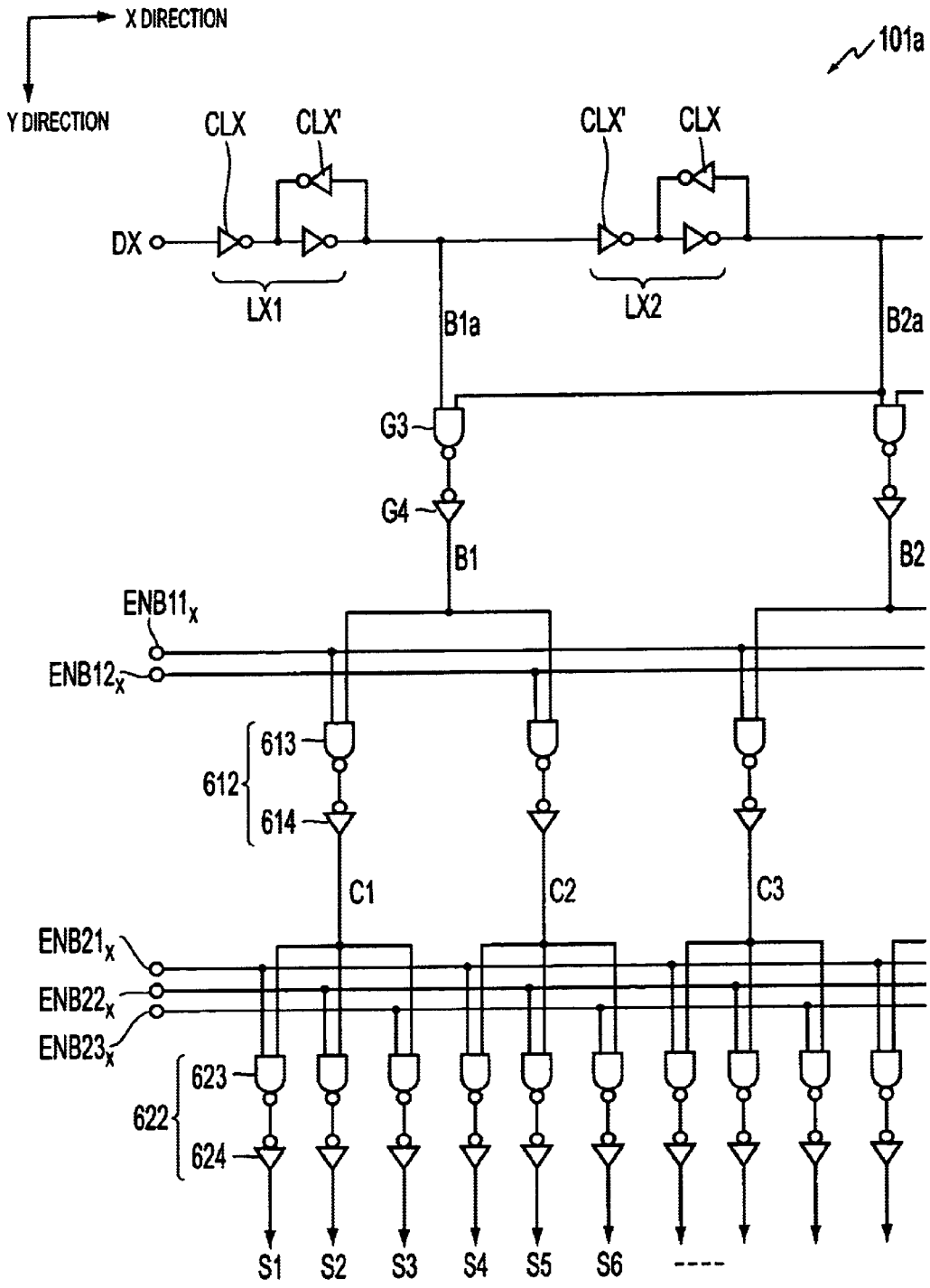
FIG. 16 is a circuit diagram illustrating the configuration of essential portions of a data-line driving circuit for use in a liquid crystal device according to a fourth embodiment of the present invention.

However, the data-line driving circuit 101 is configured, as illustrated in FIG. 16. More specifically, a data-line driving circuit 101 a of the fourth embodiment is similar to the data-line driving circuit 101 -of one of the aforementioned first through third embodiments (see FIG. 7) in that an AND signal of an output signal of each unit circuit forming the shift register 600 and an output signal of the subsequent-stage unit circuit is obtained by a NAND gate G3 and an inverter G4 connected in series and is output as a transfer signal. However, the data-line driving circuit 101*a* is different from the data-line driving circuit 101 in that the transfer signal is branched off into two components, each component being provided with a first enable circuit 612, and an output signal of the first enable circuit 612 is further branched into three portions, each portion being provided with a second enable circuit 622.

The first enable circuit 612 is formed by connecting in series a first NAND gate 613 for outputting a NAND signal of one of the two branched transfer signal components and one of the first group enable signals ENB11x and ENB12x, and a first inverter 614 for outputting the inverted NAND signal. Among the two first NAND gates 613 to which the same transfer signal (before being branched) is supplied, the first group enable signal ENB11x is supplied to the first NAND gate 613 located at the left side as viewed from FIG. 16, while the first group enable signal ENB12x is supplied to the first NAND gate 613 positioned at the right side as viewed from FIG. 16.

Figure 17:
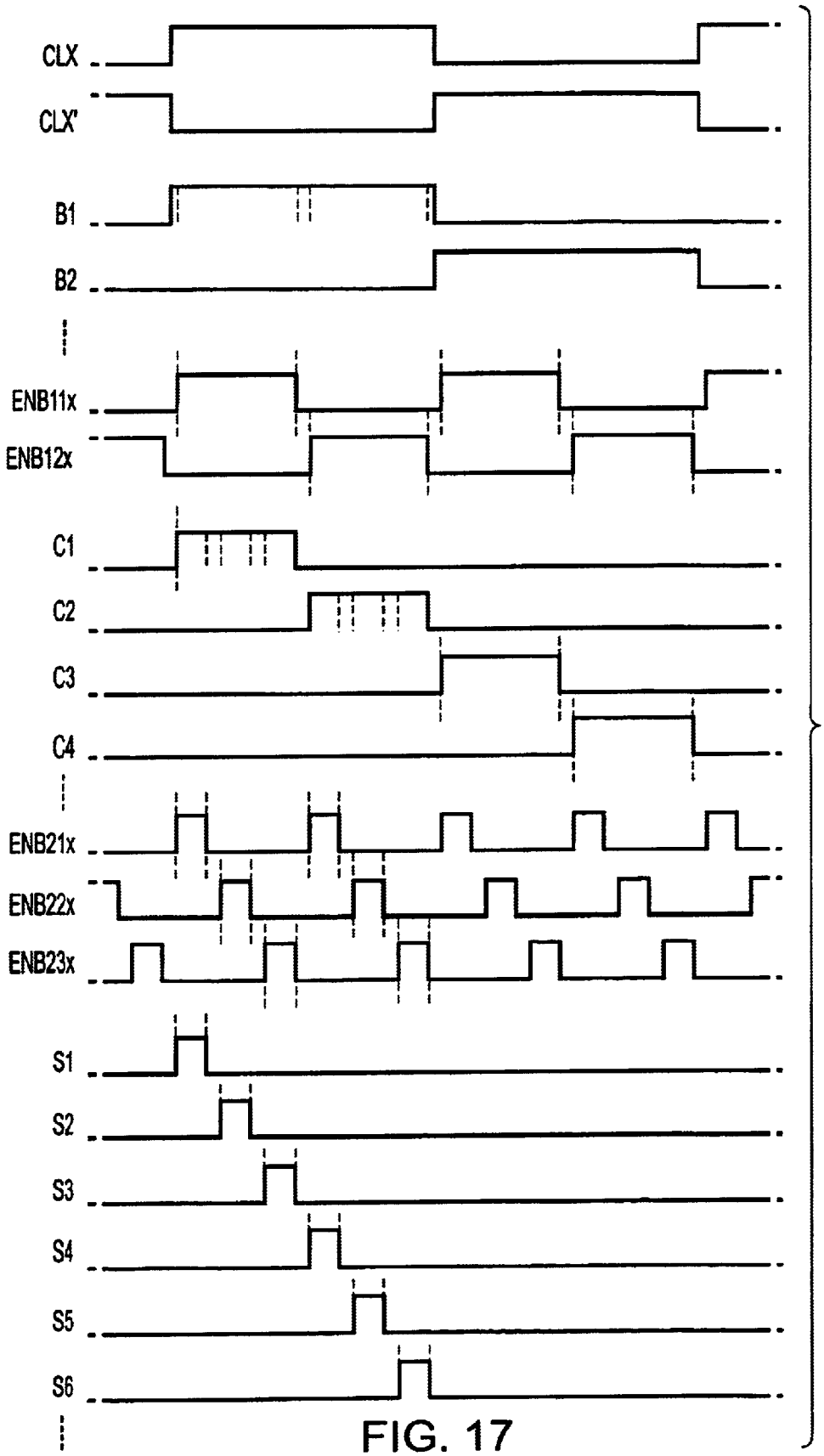
FIG. 17 is a timing chart illustrating the operation of the data-line driving circuit shown in FIG. 16 when being operated in the first operation mode.
Figure 18:
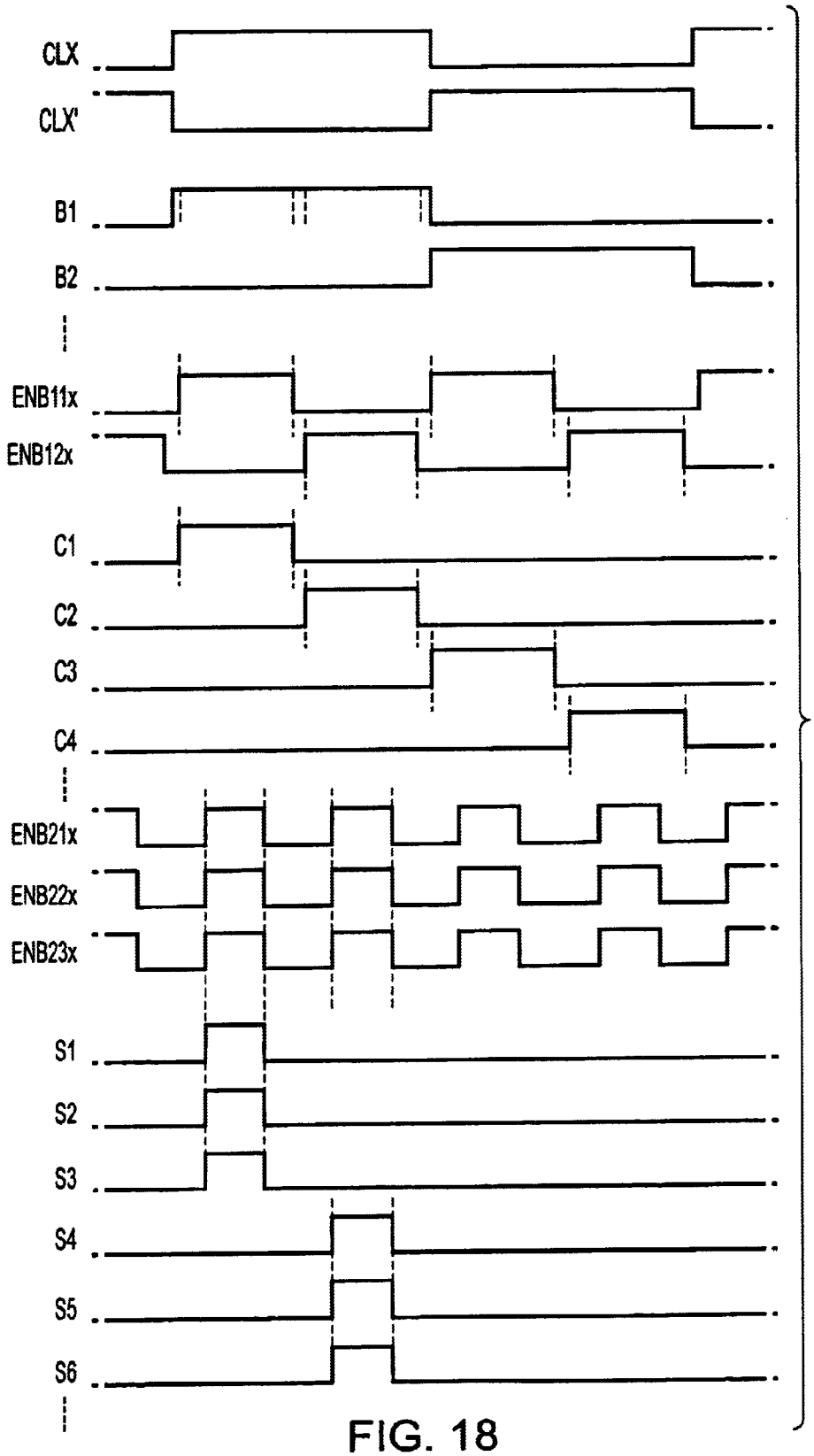
FIG. 18 is a timing chart illustrating the operation of the data-line driving circuit shown in FIG. 16 when being operated in the second operation mode.

The first group enable signals ENB11x and ENB12x are fixed signals, which are not changed by the operation mode. More specifically, as illustrated in FIGS. 17 and 18, the first group enable signals ENB11x and ENB12x have a frequency twice as high as the X-direction clock signal CLX (inverted clock signal CLX'), and the pulse widths of the enable signals ENB11x and ENB12x are approximately one-half that of the clock signal CLX (inverted clock signal CLX'), the pulse-width cycles being sequentially shifted from each other without overlapping.

For convenience of explanation, output signals of the corresponding first enable circuits 612 are indicated by C1, C2, C3 . . . counted from the leftmost enable circuit 612 in FIG. 16. Then, the output signals C1, C2, C3 . . . are generated, as shown in FIGS. 17 and 18. That is, a transfer signal B1 is first sequentially divided into two components in the time domain in accordance with the enable signals ENB11x and ENB12x so as to generate the output signals C1 and C2. Similarly, the transfer signal B2 is then sequentially divided into two components in the time domain in accordance with the enable signals ENB11x and ENB12x so as to produce the output signals C3 and C4. Thereafter, a dividing operation similar to that discussed above is repeated regardless of the operation mode.

The output signal component of each first enable circuit 612 is further branched off into three portions, and a second enable circuit 622 is provided for each branched component. More specifically, the second enable circuit 622 is formed by connecting in series a second NAND gate 623 for outputting a NAND signal of one of the three branched output signal components and one of the second group enable signals ENB21x, ENB22x, and ENB23x, and a second inverter 624 for outputting the inverted NAND signal. The inverted output signal of the second inverter 624 is output as a sampling control signal via the corresponding sampling control signal line 308 (see FIG. 11). Among the three second NAND gates 623 to which the same signal (before being branched) is supplied, the second group enable signal ENB21x is supplied to the NAND gate 623 located on the left side in FIG. 16, the second group enable signal ENB22x is supplied to the NAND gate 623 placed at the intermediate position, and the second group enable signal ENB23x is supplied to the NAND gate 623 positioned on the right side in FIG. 16.

Unlike the first group enable signals ENB11x and ENB12x, the second group enable signals ENB21x, ENB22x, and ENB23x are variable by the operation mode. More specifically, in the first operation mode (sequential driving), the second group enable signals ENB21x, ENB22x, and ENB23x have a frequency four times as high as the X-direction clock signal CLX (inverted clock signal CLX'), as illustrated in FIG. 17. The pulse width of the enable signals ENB21x, ENB22x, and ENB23x are approximately one-third those of the first group enable signals ENB11x and ENB12x, and the pulse-width cycles are sequentially shifted from each other without overlapping. In the second operation mode (simultaneous-multiple driving), the enable signals ENB21x, ENB22x, and ENB23x have a frequency four times as high as the X-direction clock signal CLX (inverted clock signal CLX'), as shown in FIG. 18. The pulse widths of the enable signals ENB21x, ENB22x, and ENB23x are shorter than those of the first group enable signals ENB11x and ENB12x, and the pulse-width cycles are in phase.

Thus, in the first mode, the sampling control signals S1, S2, S3 . . . of the corresponding second group enable circuits 622 are generated, as shown in FIG. 17. More specifically, the output signal C1 of the first enable circuit 612 located at the leftmost position in FIG. 16 is sequentially divided into three components in the time domain in accordance with the second enable signals ENB21x, ENB22x, and ENB23x so as to generate the sampling control signals S1, S2, and S3. Likewise, the output signal C2 of the first enable circuit 612, which is the second circuit counted from the leftmost circuit, is sequentially divided into three components in the time domain in accordance with the enable signals ENB21x, ENB22x, and ENB23x so as to produce the sampling control signals S4, S5, and S6. Thereafter, a dividing operation similar to that stated above is repeated. As a result, in the first operation mode, the sampling control signals S1, S2, S3, . . . are output while being sequentially shifted from each other without overlap of the pulse widths.

In contrast, in the second mode, the sampling control signals S1, S2, S3 . . . of the corresponding second enable circuits 622 are indicated, as illustrated in FIG. 18. More specifically, the output signal C1 of the first enable circuit 612 located at the leftmost position in FIG. 16 is simultaneously distributed into three portions in accordance with the second group enable signals ENB21x, ENB22x, and ENB23x so as to generate the sampling control signals S1, S2, and S3. Similarly, the output signal C2 of the first enable circuit 612, which is the second circuit counted from the leftmost circuit, is simultaneously distributed into three portions in accordance with the second group enable signals ENB21x, ENB22x, and ENB23x so as to produce the sampling control signals S4, S5, and S6. Thereafter, a distributing operation similar to that discussed above is repeated. As a result, in the second operation mode, the sampling control signals S1, S2, S3 . . . become identical in units of three control signals, and the individual units of the sampling control signals S1 through S3, S4 through S6, S7 through S9, . . . are output while being sequentially shifted from each other.

According to the foregoing description, in the fourth embodiment, the transfer signal output in correspondence with each unit circuit of the X-direction shift register 600 is first sequentially divided into two components in the time domain by the first enable circuit 612, thereby obtaining two signals without overlap of the pulse widths. Between the two signals, in the first mode, one of the signals is sequentially divided into three portions in the time domain by the second enable circuits 622, thereby obtaining three sampling signals without overlap of the pulse widths. In the second mode, however, one of the two signals is simultaneously distributed into three portions by the second enable circuits 622, thereby acquiring the three sampling signals of the same type having the same pulse width.

The writing operation performed by sequential driving in the first operation mode, and the writing operation performed by simultaneous-multiple driving in the second operation mode are similar to those of the third embodiment, and an explanation thereof will thus be omitted.

In this embodiment, six sampling control signals are generated for each unit circuit forming the shift register 600. It is thus possible to further relax the limit of the X-direction pitch of the unit circuit of the shift register 600 compared to the third embodiment. More specifically, the number of stages of the unit circuits of the shift register 600 is reduced to "one sixth", which is the reciprocal of the product of the number, namely, two, of signal components divided by the first enable circuit 612 and the number, namely, three, of signal portions divided by the second enable circuit 622, thereby greatly contributing to a reduction in the pixel pitch, in combination with the decreased Y-direction pitch achieved in the first embodiment. Further, the driving frequency of the shift register can be decreased to one sixth, thereby making it possible to reduce power consumption.

The other factors of this embodiment are similar to those of the first through third embodiments. That is, in the scanning-line driving circuit 104, the pitch of the unit circuit forming the (Y-direction) shift register 500 is decreased. The X-direction or Y-direction enable circuit may be formed by a transmission gate or a P-channel type or N-channel type TFT. The enable circuits may be arranged while being sequentially shifted from each other with a fixed interval in the corresponding direction, or may be arranged while being alternately displaced from each other in the corresponding direction.

The first group enable signals ENB11x and ENB12x and the second group enable signals ENB21x, ENB22x, and ENB23x are generated as the timing signal Sdt by the signal processor 204, such as that shown in FIG. 14 or 15, in accordance with the setting of the input unit 209 or the motion of the image.

In the fourth embodiment, the number of signal components divided by the first enable circuit 612 is two, and the number of signal portions divided by the second enable signal 622 is three. It is needless to say, however, that the present invention is not limited to these numbers.

Figure 19:
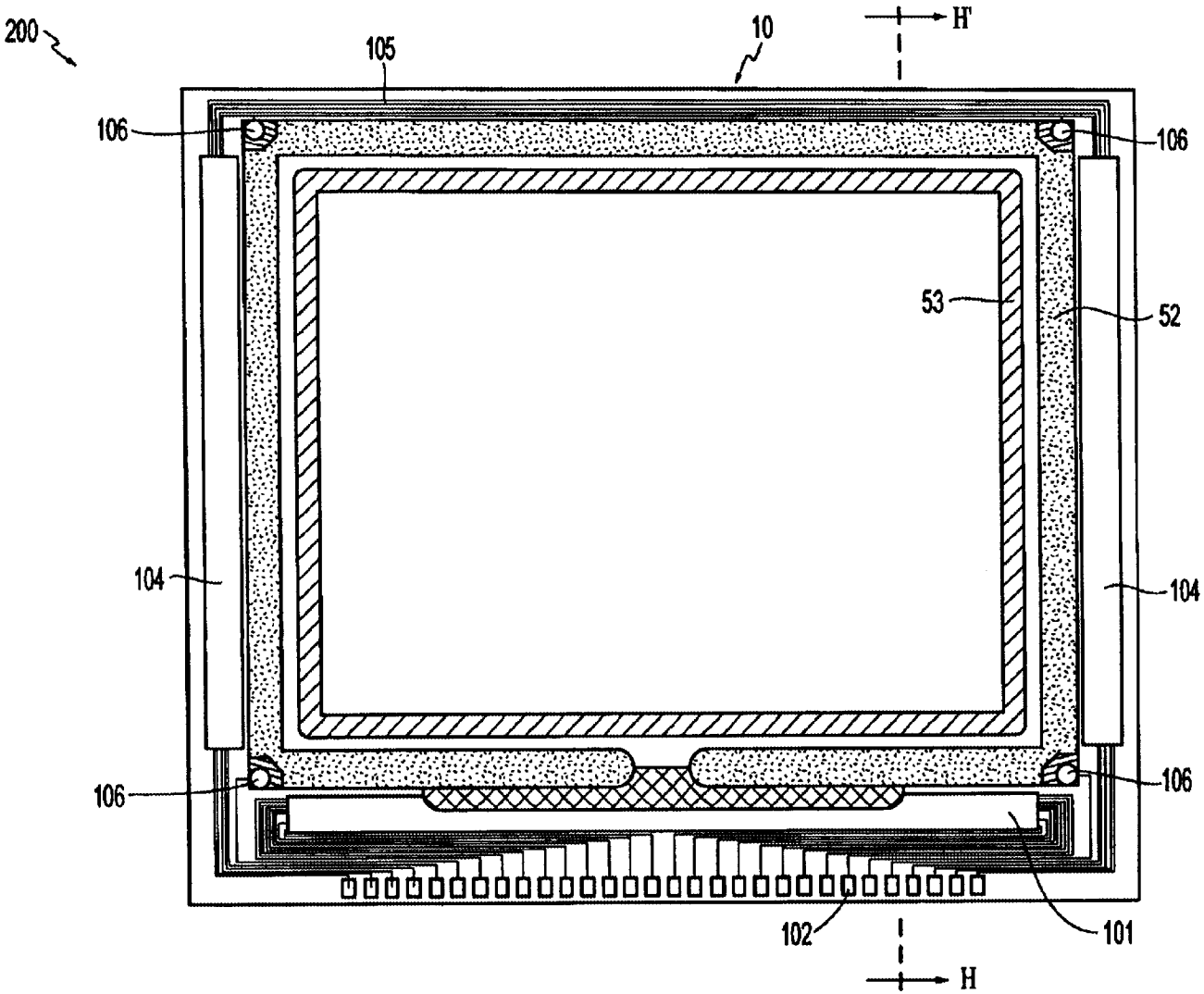
FIG. 19 is a plan view illustrating the configuration of the liquid crystal device according to one of the embodiments.
Figure 20:
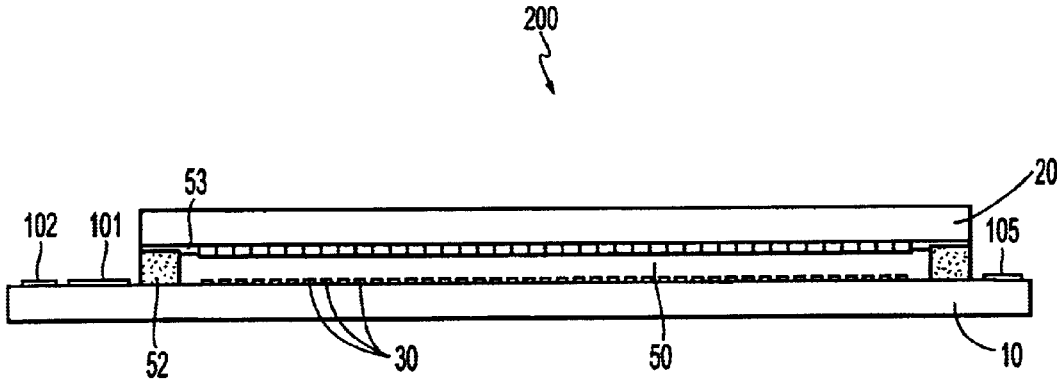
FIG. 20 is a sectional view taken along line H–H' of FIG. 19.

The overall configuration of the liquid crystal device according to the foregoing embodiments is now described with reference to FIGS. 19 and 20. FIG. 19 is a plan view illustrating the configuration of the liquid crystal device. FIG. 20 is a sectional view taken along line H–H' of FIG. 19.

The liquid crystal device 200 is configured in the following manner, as shown in FIGS. 19 and 20. A TFT array substrate 10 on which TFTs 30 and pixel electrodes are formed and an opposing substrate 20 on which opposing electrodes are formed are fixed with a predetermined gap therebetween in such a manner that the surfaces of the corresponding substrates on which the electrodes are formed face each other. In the liquid crystal device 200, a liquid crystal 50, which is an example of an electro-optical material, is sealed with a seal adhesive 52 in the gap between the TFT array substrate 10 and the opposing substrate 20. A light-shielding film 53, which serves as what is called a frame, for partitioning the screen display portion and the peripheral portion is provided on the opposing surface of the opposing substrate 20 and at the inner side of the sealing adhesive 52. The data-line driving circuit 101 is formed, together with the sampling circuit 302 (not shown in FIGS. 19 or 20), on the opposing surface of the TFT array substrate 10 and at one outer side of the sealing adhesive 52, thereby driving the data lines. At the same outer side of the sealing adhesive 52, a plurality of connecting electrodes 102 are formed to input various timing signals and image signals from the image signal processing circuit. Moreover, on both sides adjacent to the above outer side of the sealing adhesive 52, the scanning-line driving circuits 104 are formed to drive the scanning lines from both sides. If the delay of scanning signals supplied to the scanning lines is negligible, the scanning-line driving circuit 104 may be formed on only one side. Additionally, in order to reduce a load in writing into the data lines, a precharge circuit may be provided on the TFT array substrate 10 to precharge predetermined potentials of the corresponding data lines before writing an image signal. An inspection circuit may be disposed to examine the quality of the liquid crystal device and to inspect for defects, and so on.

The remaining side of the TFT array substrate 10 is provided with a plurality of wiring patterns 105 for connecting the scanning-line driving circuits 104 arranged at both sides of the screen display portion. A conductive material 106 is provided at each of the four corners of the opposing substrate 20 so as to electrically connect the TFT array substrate 10 and the opposing substrate 20.

Moreover, on the opposing substrate 20, according to the purpose of use or the necessity of the liquid crystal device 200, for example, first of all, a color filter is provided with a predetermined arrangement, and a black matrix is provided to fill the gaps of the color filter. Secondly, a backlight is provided to apply light to the liquid crystal device 200. In particular, when the liquid crystal device 200 is used for colored-light modulation, not a color filter, but only a black matrix is provided on the opposing substrate 20.

In addition, an alignment film (not shown), which has been rubbed in a predetermined orientation, is disposed on the opposing surface of the TFT array substrate 10 and on the opposing surface of the opposing substrate 20. A polarizer which matches the alignment orientation of the liquid crystal, and a retardation film (neither of which is shown) are provided on the rear surfaces of the TFT array substrate 10 and the opposing substrate 20. If, however, a polymer dispersed liquid crystal in which droplets are dispersed in a polymer is used as the liquid crystal 50, the above-described alignment film, the polarizer, the retardation film, and the like are made unnecessary. Accordingly, the light can be utilized more efficiently, thereby advantageously enhancing the luminance and decreasing the power consumption.

The scanning-line driving circuits 104 used in the individual embodiments may be divided and provided, as shown in FIG. 19, at both (left and right) sides of the screen display portion, and the scanning lines 31 of the corresponding scanning-line driving circuit 104 may be alternately patterned from the respective sides of the screen display portion. More specifically, for example, the odd-numbered scanning lines 31 numbered from the uppermost scanning line 31 may be driven by one of the scanning-line driving circuits 104 arranged on the left and right sides, while the even-numbered scanning lines 31 may be driven by the other scanning-line driving circuit 104. With this arrangement, the scanning lines 31 are alternately driven from the left and right sides of the screen display portion, thereby making it possible to relax by a factor of two the Y-direction circuit pitch of the unit circuit forming the shift register 500 of the scanning-line driving circuit 104. However, the configuration in which the scanning lines are simultaneously driven from both sides is more advantageous in terms of reducing the delay time of scanning signals.

In the foregoing embodiments, the TFT array substrate 10 is formed by a transparent insulating substrate, such as glass, and switching elements (TFTs 116) of the pixel portions and the elements of the driving circuits are formed on the substrate. However, the present invention is not restricted to the above configuration. For example, the substrate 10 may be formed by a semiconductor substrate, and the switching elements of the pixel portions and the elements of the driving circuits may be formed on the surface of the semiconductor substrate by using insulated-gate field-effect transistors in which sources, drains, and channels are formed. Since the substrate 10 formed of a semiconductor substrate is unusable as a transmissive type, the pixel electrodes 11 are used as a reflective type by being formed of aluminum or the like. Alternatively, the substrate 10 may be simply a transparent substrate, and the pixel electrodes 11 may be used as a reflective type.

Further, according to the foregoing description, although in the foregoing embodiments the switching elements of the pixel portions are three-terminal elements represented by TFTs, they may be formed of two-terminal elements, such as diodes. In this case, however, it is necessary to form the scanning lines 31 on one of the substrates and to form the data lines 35 on the other substrate, and also the two-terminal elements are required to be formed between the pixel electrodes 11 and one of the scanning lines 31 and the data lines 35.

Additionally, according to the foregoing description, the aforementioned embodiments are employed as a liquid crystal device using a liquid crystal as an electro-optical material. However, the present invention is not limited to the liquid crystal device, and may be applied to, for example, a display device that uses an electro luminescent element as an electro-optical material rather than a liquid crystal so as to perform a display operation by utilizing the electro-optical effect. That is, the present invention is applicable to all types of electro-optical devices which are configured similarly to the above-described liquid crystal device.

Figure 21:
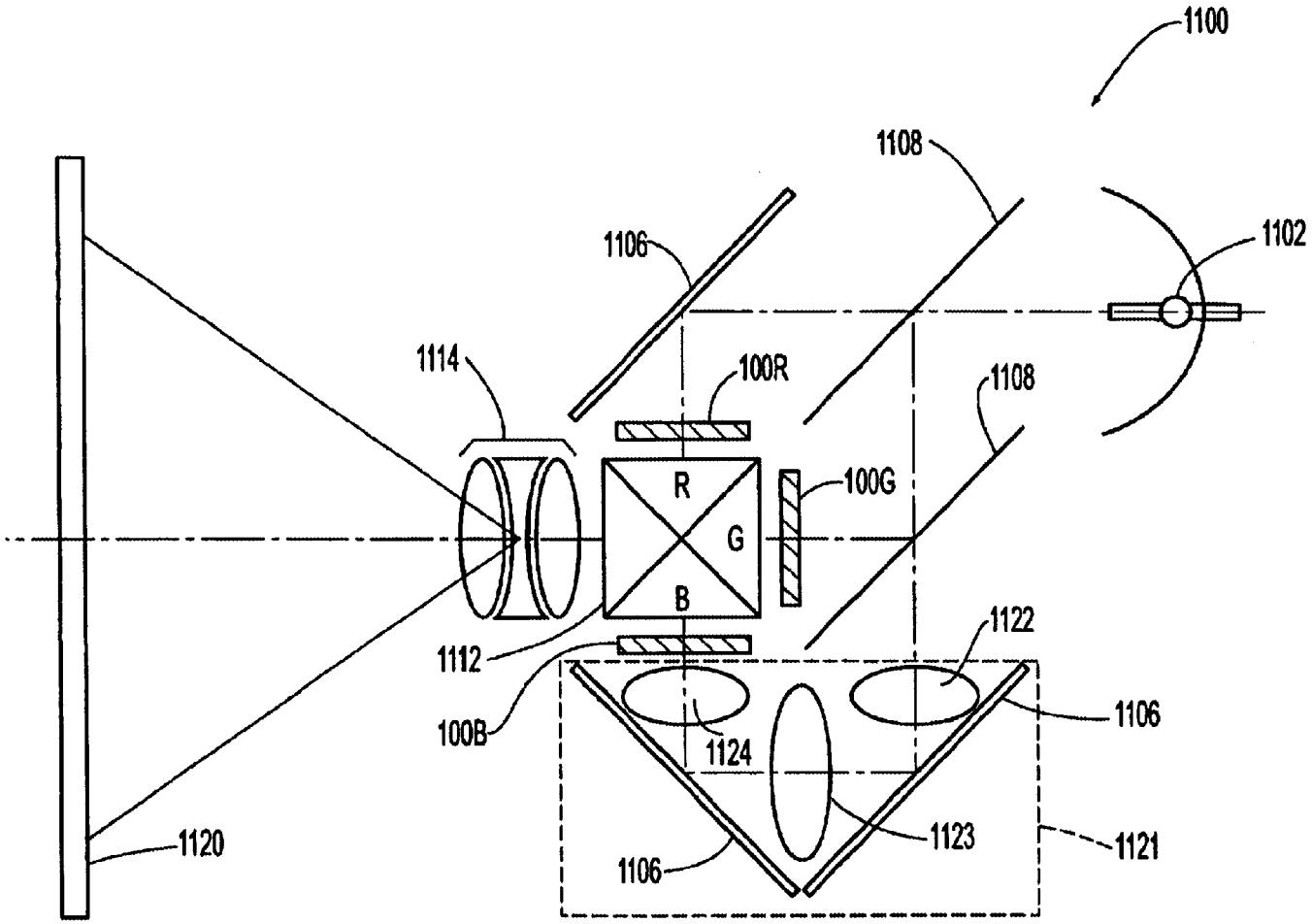
FIG. 21 is a plan view illustrating the configuration of a liquid crystal projector using any one of the liquid crystal devices of the corresponding embodiments.

A description is now given of a liquid crystal projector as an example of an electronic machine using the liquid crystal device of the foregoing embodiments. FIG. 21 is a plan view illustrating an example of the configuration of a liquid crystal projector. In a liquid crystal projector 1100, three liquid crystal modules, each including the liquid crystal device of the foregoing embodiments, are used as R (red), G (green), and B (blue) light valves 100R, 100G, and 100B, respectively.

In the liquid crystal projector 1100, as shown in FIG. 21, light emitted from a lamp unit 1102, which serves as a white light source, such as a metal halide lamp, is separated into R light, G light, and B light corresponding to three RGB primary colors by three mirrors 1106 and two dichroic mirrors 1108, and are guided to the light valves 100R, 100G, and 100B corresponding to the respective colors. In this case, in particular, the B light is guided via a relay lens system 1121 formed of an entrance lens 1122, a relay lens 1123, and an exit lens 1124 in order to suppress light loss caused by a long optical path. Then, the light components corresponding to the three primary colors, which have been optically modulated by the light valves 100R, 100G, and 100B, are again synthesized by a dichroic prism 1112, and are projected as a color image on a screen 1120 through a projection lens 1114.

The light components corresponding to the R, G, and B primary colors are incident on the light valves 100R, 100G, and 100B via the dichroic mirrors 1108, thereby eliminating the need for providing a color filter.

In addition to the liquid crystal projector, liquid crystal televisions, view-finder-type and monitor-direct-view-type video tape recorders, automobile navigation systems, pagers, electronic notes, scientific calculators, word processors, workstations, videophones, POS terminals, devices provided with touch panels, and the like may be used as examples of the electronic machines. It is needless to say that the electro-optical device of the present invention is applicable to any one of the above-described various types of electronic machines.

As is seen from the foregoing description, according to the present invention, it is possible to cope with a decreased size of the pixel pitch by using a comparatively simple circuit configuration.

What is claimed is:

1. A driving circuit system for use in an electro-optical device for driving pixels, said electro-optical device including switching elements and pixel electrodes electrically connected to said switching elements, said switching elements being disposed in correspondence with intersections of a plurality of scanning lines and a plurality of data lines, said driving circuit system comprising:

a shift register formed of a number of stages of unit circuits smaller than a number of said scanning lines, said shift register sequentially outputting a transfer signal from each of said unit circuits based on a clock signal having a predetermined period;

an output circuit that divides the transfer signal output from each of said unit circuits into a plurality of transfer signal components in a time domain, and that sequentially outputs the transfer signal components as scanning signals to said scanning lines, said output circuit comprising:

logic circuits, each logic circuit being connected between a corresponding unit circuit of said unit circuits and a subsequent-stage unit circuit, a transfer signal output from a corresponding logic circuit and a transfer signal output from a subsequent-stage logic circuit being exclusive from each other;

a branching wiring pattern, provided in correspondence with each of said logic circuits, that branches the transfer signal output from the corresponding logic circuits into the plurality of transfer signal components; and an enable circuit, provided in correspondence with each of the transfer signal components branched by said branching wiring pattern, the enable circuit comprising a transmission gate that outputs as the scanning signal when an AND signal of each of the transfer signal components and a predetermined enable signal are input, the enable signals whose active periods do not overlap with each other being supplied to the enable circuits to which the transfer signal components branched by a same branching wiring pattern are supplied.

2. A driving circuit system for use in an electro-optical device according to claim 1, adjacent ones of the enable circuits being displaced alternately along a direction in which said scanning lines are arranged.

3. A driving circuit system for use in an electro-optical device according to claim 1, each of said enable circuits comprising a NAND gate for inputting one of said transfer signal components and said predetermined enable signal therein, and an inverter for inverting an output of said NAND gate, said NAND gate and said inverter being connected in series.

4. An electro-optical device comprising said driving circuit system according to claim 1.

5. A driving circuit system for use in an electro-optical device for driving pixels, said electro-optical device including switching elements and pixel electrodes electrically connected to said switching elements, said switching elements being disposed in correspondence with intersections of a plurality of scanning lines and a plurality of data lines, said driving circuit system comprising:

a shift register formed of a number of stages of unit circuits smaller than a number of said scanning lines, said shift register sequentially outputting a transfer signal from each of said unit circuits based on a clock signal having a predetermined period;

an output circuit that divides the transfer signal output from each of said unit circuits into a plurality of transfer signal components in a time domain, and that sequentially outputs the transfer signal components as scanning signals to said scanning lines, said output circuit comprising:

a branching wiring pattern, provided in correspondence with each of said unit circuits, that branches the transfer signal output from the corresponding one of the unit circuits into the plurality of transfer signal components; and an enable circuit, provided in correspondence with each of the transfer signal components branched by said branching wiring pattern, the enable circuit outputting as the scanning signal when an AND signal of each of the transfer signal components and a predetermined enable signal are input, the enable signals whose active periods do not overlap with each other being supplied to the enable circuits to which the transfer signal components branched by a same branching wiring pattern are supplied, each of said enable circuits comprising a transmission gate that outputs said scanning signal when one of said transfer signal components and said predetermined enable signal are input.

6. An electro-optical device comprising said driving circuit system according to claim 5.

7. A driving circuit system for use in an electro-optical device for driving pixels, said electro-optical device including switching elements and pixel electrodes electrically connected to said switching elements, said switching elements being disposed in correspondence with intersections of a plurality of scanning lines and a plurality of data lines, said driving circuit system comprising:

a shift register formed of a number of stages of unit circuits smaller than a number of said data lines, said shift register sequentially outputting a transfer signal from each of said unit circuits based on a clock signal having a predetermined period;

an output circuit that divides the transfer signal output from each of said unit circuits into a plurality of transfer signal components in a time domain, and that outputs the transfer signal components as sampling control signals;

a sampling switch, provided in correspondence with each of said data lines, that samples an image signal according to the sampling control signals divided by said output circuit, and that supplies the image signal to the corresponding one of the data lines;

said output circuit comprising:

logic circuits, each logic circuit being connected between a corresponding unit circuit of said unit circuits and a subsequent-stage unit circuit, a transfer signal output from a corresponding logic circuit and a transfer signal output from a subsequent-stage logic circuit being exclusive from each other;

a branching wiring pattern, provided in correspondence with each of said logic circuits, that branches the transfer signal output from the corresponding logic circuits into the plurality of transfer signal components; and an enable circuit, provided in correspondence with each of the transfer signal components branched by said branching wiring pattern, the enable circuit comprising a transmission gate that outputs as the sampling control signal when an AND signal of each of the transfer signal components and a predetermined enable signal are input, the enable signals whose active periods do not overlap with each other being supplied to the enable circuits to which the transfer signal components branched by a same branching wiring pattern are supplied.

8. A driving circuit system for use in an electro-optical device according to claim 7, each of said enable circuits comprising a NAND gate for inputting one of said transfer signal components and said predetermined enable signal therein, and an inverter for inverting an output of said NAND gate, said NAND gate and said inverter being connected in series.

9. A driving circuit system for use in an electro-optical device according to claim 7, each of said enable circuits comprising a transmission gate that outputs said sampling control signal when one of said transfer signal components and said predetermined enable signal are input.

10. A driving circuit system for use in an electro-optical device for driving pixels, the electro-optical device including switching elements and pixel electrodes electrically connected to the switching elements, the switching elements being disposed in correspondence with intersections of a plurality of scanning lines and a plurality of data lines, the driving circuit system comprising:

a shift register formed of a number of stages of unit circuits smaller than a number of the scanning lines, the shift register sequentially outputting a transfer signal from each of the unit circuits based on a clock signal having a predetermined period;

an output circuit that divides the transfer signal output from each of the unit circuits into a plurality of transfer signal components in a time domain, and that sequentially outputs the transfer signal components as scanning signal to the scanning lines, the output circuit comprising:

logic circuits, each logic circuit being connected between a corresponding unit circuit of said unit circuits and a subsequent-stage unit circuit, a transfer signal output from a corresponding logic circuit and a transfer signal output from a subsequent-stage logic circuit being exclusive from each other;

a branching wiring pattern, provided in correspondence with each of the logic circuits, that branches the transfer signal output from the corresponding logic circuits into the plurality of transfer signal components; and an enable circuit, provided in correspondence with each of the transfer signal components branched by the branching wiring pattern, the enable circuit comprising a transmission gate that outputs as the scanning signal based on the each of the transfer signal components and a predetermined enable signal.

11. An electro-optical device comprising the driving circuit system according to claim 10.

12. A driving circuit system for use in an electro-optical device for driving pixels, the electro-optical device including switching elements and pixel electrodes electrically connected to the switching elements, the switching elements being disposed in correspondence with intersections of a plurality of scanning lines and a plurality of data lines, the driving circuit system comprising:

a shift register formed of a number of stages of unit circuits smaller than a number of the data lines, the shift register sequentially outputting a transfer signal from each of the unit circuits based on a clock signal having a predetermined period;

an output circuit that divides the transfer signal output from each of the unit circuits into a plurality of transfer signal components in a time domain, and that outputs the transfer signal components as sampling control signals;

a sampling switch, provided in correspondence with each of the data lines, that samples an image signal supplied to one of a plurality of image signal lines according to the transfer signal divided by the output circuit, and that supplies the image signal to the corresponding one of the data lines;

the output circuit comprising:

logic circuits, each logic circuit being connected between a corresponding unit circuit of said unit circuits and a subsequent-stage unit circuit, a transfer signal output from a corresponding logic circuit and a transfer signal output from a subsequent-stage logic circuit being exclusive from each other;

a branching wiring pattern, provided in correspondence with each of the logic circuits, that branches the transfer signal output from the corresponding logic circuit into the plurality of transfer signal components; and an enable circuit, provided in correspondence with each of the transfer signal components branched by the branching wiring pattern, the enable circuit comprising a transmission gate that outputs as the sampling control signal based on the each of the transfer signal components and a predetermined enable signal.

13. An electro-optical device comprising the driving circuit system according to clam 12.

* * * * *